US009815295B2

(12) United States Patent
Kudo et al.

(10) Patent No.: US 9,815,295 B2
(45) Date of Patent: Nov. 14, 2017

(54) TANK, TANK UNIT, LIQUID EJECTION SYSTEM, AND LIQUID EJECTION APPARATUS

(71) Applicant: SEIKO EPSON CORPORATION, Tokyo (JP)

(72) Inventors: Shoma Kudo, Nagano (JP); Soshi Okawa, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/296,356

(22) Filed: Oct. 18, 2016

(65) Prior Publication Data

US 2017/0106664 A1 Apr. 20, 2017

(30) Foreign Application Priority Data

Oct. 20, 2015 (JP) ..... 2015-205965

(51) Int. Cl.
*B41J 2/19* (2006.01)
*B41J 2/175* (2006.01)

(52) U.S. Cl.
CPC ..... *B41J 2/19* (2013.01); *B41J 2/1752* (2013.01); *B41J 2/17509* (2013.01); *B41J 2/17513* (2013.01); *B41J 2/17536* (2013.01); *B41J 2/17553* (2013.01); *B41J 2/17566* (2013.01)

(58) Field of Classification Search
CPC ..... B41J 2/19
See application file for complete search history.

(56) References Cited

U.S. PATENT DOCUMENTS

2012/0026254 A1* 2/2012 Tamaki ..... B41J 2/17509 347/85
2012/0236072 A1* 9/2012 Kikkawa ..... B41J 2/16523 347/36
2016/0009096 A1 1/2016 Suzuki et al.
2016/0009100 A1 1/2016 Kudo et al.
2016/0016409 A1 1/2016 Kimura et al.

FOREIGN PATENT DOCUMENTS

CN 104015492 A 9/2014

* cited by examiner

*Primary Examiner* — Alessandro Amari
*Assistant Examiner* — Roger W Pisha, II
(74) *Attorney, Agent, or Firm* — Global IP Counselors, LLP

(57) ABSTRACT

A tank includes a liquid containing portion, an air introduction portion that enables the air to be introduced into the liquid containing portion, a liquid injection portion that enables the liquid to be injected into the liquid containing portion. The air introduction portion includes a first air introduction portion that is in communication with the liquid containing portion, and a second air introduction portion. The first air introduction portion includes a first air introduction port and a first air flow path. The second air introduction portion includes a second air introduction port and a second air flow path. A first member that is configured to pass the air through the inside and is configured to block the liquid through the inside. A second member that is configured to pass the air through the inside and is configured to block the liquid through the inside.

14 Claims, 21 Drawing Sheets

TANK, TANK UNIT, LIQUID EJECTION SYSTEM, AND LIQUID EJECTION APPARATUS

CROSS REFERENCE TO RELATED APPLICATION

This application claims priority to Japanese Patent Application No. 2015-205965 filed on Oct. 20, 2015, the entire contents of this application are incorporated by reference herein.

BACKGROUND

1. Technical Field

The present invention relates to tanks, tank units, liquid ejection systems, and liquid ejection apparatuses.

2. Related Art

A known mode of a liquid ejection system or a liquid ejection apparatus is an inkjet printer (hereinafter also referred to simply as a "printer") in which ink is discharged to printing paper to form an image. A printer usually includes an ink tank serving as a tank for containing ink to be supplied to a print head, which is a mode of a liquid ejection head, and a tank unit in which the ink tank is housed. The ink tank is provided with an air communicating path such that the outside air is introduced into the ink tank as the ink is consumed. Some kind of ink tank is provided with an ink injection port that enables a user to supply ink from the outside (e.g. see Chinese Patent Application Publication No. CN104015492A below).

Such an ink tank including the air communicating path and the ink injection port is attached to a printer, and is carried together with the printer with the ink contained therein, in some cases. When this printer is carried, for example, there are cases where the printer is brought into an orientation that is different from a usual orientation, which is assumed when the printer is used. There are also cases where the printer is disposed in an environment that is different from the usual environment, such as a place where the temperature is significantly higher than in an environment where the printer is used that is assumed at the time of shipping from the factory, or a place where the altitude is high and the atmospheric pressure is significantly low. For this reason, regarding this kind of ink tank, a device for preventing the ink in the ink tank from leaking from the air communicating path or the ink injection port even in such a situation is required.

SUMMARY

The invention has been made in order to solve at least a part of the foregoing problem in an ink tank in a printer, as well as in a tank for containing liquid, a tank unit, a liquid ejection system, and a liquid ejection apparatus, and can be achieved in the following modes.

[1] According to a first mode of the invention, a tank with which liquid can be supplied to a liquid ejection head is provided. The tank may include a liquid containing portion, an air introduction portion, a liquid injection portion, and a sealing member. The liquid containing portion may be configured to contain the liquid. The air introduction portion, through which outside air is introduced into the liquid containing portion. The liquid injection portion, through which the liquid is injected into the liquid containing portion from outside. The sealing member may be detachably attached to the liquid injection portion. The air introduction portion may include a first air introduction portion that is in communication with the liquid containing portion, and a second air introduction portion. The first air introduction portion may include a first air introduction port that is open in the liquid containing portion, and a first air flow path that constitutes a flow path for the air from the outside to the first air introduction port. The second air introduction portion may include a second air introduction port that is open in the liquid containing portion, and a second air flow path that is a flow path for the air from the outside to the second air introduction port. In a state where the air and the liquid that occupies half a liquid capacity of the liquid containing portion are contained in the liquid containing portion, (i) when the tank is in a first orientation, which is an orientation when the liquid is injected from the liquid injection portion, the first air introduction port may be located in a region where the air exists, and the second air introduction port may be located in a region where the liquid exists, and (ii) when the tank is in a second orientation, in which the tank is rotated by 180 degrees relative to the first orientation such that upper and lower sides thereof are inverted, the first air introduction port may be located in a region where the liquid exists, and the second air introduction port may be located in a region where the air exists. In the first air flow path, a first member is configured to pass through the inside and is configured to block the liquid through the inside. The first member may be disposed so as to block the first air flow path. In the second air flow path, a second member may be configured to pass the air through the inside and may be configured to block the liquid through the inside. The second member may be disposed so as to block the second air flow path. With the tank in this mode, leakage of the liquid via the air introduction portion or the liquid injection portion is suppressed both when the tank is in the first orientation and when in the second orientation. Also, an air distribution passage for the liquid containing chamber is formed both when the tank is in the first orientation and when in the second orientation. Therefore, the liquid in the liquid containing chamber being pushed to the outside via the air introduction portion or the liquid injection portion by the air that has expanded within the liquid containing chamber due to a change in an environmental condition such as the environmental temperature, the altitude, or the atmospheric pressure is suppressed.

[2] In the tank in the above mode, the first air flow path may include a first liquid containing chamber in which the liquid that flow into the first air flow path is configured to be stored in an orientation obtained by rotating the tank from the first orientation. With the tank in this mode, the liquid is stored in the first liquid containing chamber. Accordingly, leakage of the liquid in the liquid containing portion to the outside via the first air introduction portion is suppressed.

[3] In the tank in the above mode, the second air flow path may include a second liquid containing chamber in which the liquid that flow into the second air flow path is configured to be stored, between the second air introduction port and the second member. With the tank in this mode, the liquid is stored in the second liquid containing chamber. Accordingly, leakage of the liquid in the liquid containing portion to the outside via the second air introduction portion is suppressed.

[4] In the tank in the above mode, a volume of the second liquid containing chamber may be a volume greater than or equal to a volume of a flow path space between the second air introduction port and the second liquid containing chamber. With the tank in this mode, the liquid that has flown into a space between the second air introduction port and the second liquid containing chamber can be stored in the second liquid containing chamber. Accordingly, leakage of the liquid via the second air introduction portion is further suppressed.

[5] At least one of the first member and the second member may be joined to the tank on the outside of the tank. With the tank in this mode, attachment of the first member and the second member are facilitated, and leakage of the liquid caused by the coming-off of the first member and the second member is suppressed.

[6] In the tank in the above mode, at least one of the first member and the second member may be detachably attached to the tank on the outside of the tank. With the tank in this mode, attachment of the first member and the second member is facilitated.

[7] The tank in the above mode may include a first wall portion disposed along a horizontal plane perpendicular to a gravity direction in the first orientation; a second wall portion opposing the first wall portion, the second wall portion being located above the first wall portion in the first orientation; a third wall portion intersecting the first wall portion and the second wall portion; a fourth wall portion intersecting the first wall portion and the second wall portion, and opposing the third wall portion; a fifth wall portion intersecting the first wall portion, the second wall portion, the third wall portion, and the fourth wall portion; and a sixth wall portion intersecting the first wall portion, the second wall portion, the third wall portion, and the fourth wall portion, and opposing the fifth wall portion. In a state where at least the air and the liquid that occupies half a liquid capacity of the liquid containing portion are contained in the liquid containing portion, the air may exist in at least one of the first air flow path and the second air flow path when the tank is placed in any one of the first orientation, the second orientation, a third orientation in which the third wall portion is disposed along the horizontal plane and the fourth wall portion is located above the third wall portion, a fourth orientation in which the fourth wall portion is disposed along the horizontal plane and the third wall portion is located above the fourth wall portion, a fifth orientation in which the fifth wall portion is disposed along the horizontal plane and the sixth wall portion is located above the fifth wall portion, and a sixth orientation in which the sixth wall portion is disposed along the horizontal plane and the fifth wall portion is located above the sixth wall portion. With the tank in this mode, leakage of the liquid from the air introduction portion is suppressed even if the tank is placed in various orientations when disposed.

[8] In the tank in the above mode, when the tank is in the first orientation in a state where the air and the liquid that occupies half a liquid capacity of the liquid containing portion are contained in the liquid containing portion, at least one of the first member and the second member may be located above a liquid surface in the liquid containing portion. With the tank in this mode, at least one of the first member and the second member being brought into contact with the liquid is suppressed. Accordingly, distributability of the air in the liquid containing portion can be achieved more reliably.

[9] In the tank in the above mode, at least in a state where the overall first member and second member are wet with the liquid, the first member and the second member may be able to let the air pass through under a pressure lower than or equal to a limit pressure from the inside of the liquid containing portion under which the sealing member coming off of the liquid injection portion is suppressed. With the tank in this mode, a pressure greater than a limit pressure being generated in the liquid containing portion is suppressed. Accordingly, the sealing member coming off of the liquid injection port is suppressed. Accordingly, leakage of the liquid via the liquid injection port is suppressed.

[10] According to a second mode of the invention, a tank unit is provided. The tank unit in this mode may include a tank and an exterior portion. The tank may be a tank described in any of the above modes. The exterior portion may house the tank. The tank may include a visual check portion that is configured to visually check a position of a surface of the liquid contained in the liquid containing portion to be visually checked. The exterior portion may include a window portion that enables the visual check portion of the tank to be visually checked from the outside. When the tank is in the first orientation, the first air introduction port may be located at a higher position than an upper end of the window portion. With the tank unit in this mode, leakage of the liquid from the tank is suppressed. In particular, the liquid being supplied until the liquid surface reaches the position of the first air introduction port is suppressed. Accordingly, the liquid flowing into the first air introduction port is suppressed, and leakage of the liquid via the first air introduction port is suppressed.

[11] According to a second mode of the invention, a liquid ejection system is provided. The liquid ejection system in this mode may include a tank unit and a liquid ejection apparatus. The tank unit may be the tank unit in the above mode. The liquid ejection apparatus may have the liquid ejection head, and the tank unit may be connected to the liquid ejection apparatus. With the liquid ejection system in this mode, leakage of the liquid from the tank in the tank unit is suppressed.

[12] According to a third mode of the invention, a liquid ejection apparatus is provided. The liquid ejection apparatus in this mode may include a tank, a liquid ejection head, and an exterior portion. The tank may be the tank in any of the above modes. The liquid ejection head may be supplied with the liquid from the tank. The exterior portion may house the tank and the liquid ejection head. The tank may have a visual check portion that enables a liquid surface of liquid contained in the liquid containing portion to be visually checked from the outside. The exterior portion may be provided at a position opposing the visual check portion of the tank, and have a window portion that enables the visual check portion to be visually checked from the outside of the exterior portion. With the liquid ejection apparatus in this mode, leakage of the liquid from the tank is suppressed. In particular, a user can visually check the amount of liquid contained in the liquid containing portion via the visual check portion. Accordingly, the occurrence of malfunction due to an inappropriate amount of the liquid contained in the tank is suppressed.

[13] In the liquid ejection apparatus in the above mode, the visual check portion may include an upper limit index portion that indicates a guide of an upper limit position of the liquid surface in the liquid containing portion when the tank is in the first orientation, and the first air introduction portion may be located above the upper limit index portion in the first orientation. With the liquid ejection apparatus in this mode, when the liquid is supplied, the liquid flowing into the first air introduction port is suppressed. Accordingly, leakage of the liquid to the outside via the first air introduction port is suppressed.

[14] In the liquid ejection apparatus in the above mode, the exterior portion may include, at a position opposing the tank contained in the exterior portion, a lid member that is attached in an openable and closable manner and is provided with the window portion. With the liquid ejection apparatus in this mode, the tank housed inside can be readily accessed. Accordingly, usability and maintainability of the liquid ejection apparatus are improved.

Not all of the plurality of constituent elements provided in the above respective modes of the invention are essential, and some of the plurality of constituent elements may be modified, deleted, or replaced with other new constituent elements, or the limitations may be partially deleted as appropriate, in order to solve a part of or the entire problem described above or in order to achieve some or all of the effects described in this specification. To solve a part of or the entire problem described above, or to achieve some or all of the effects described in this specification, some or all of the technical features included in one of the above modes of the invention may be combined with some or all of the technical features included in the other of the above modes of the invention to make an independent mode of the invention.

The invention can also be achieved in various modes other than a tank, a tank unit, a liquid ejection system, and a liquid ejection apparatus. For example, the invention is achievable as a liquid and air flow path structure in a tank. Note that "system" in this specification means an assembly in which a plurality of constituent elements are integrally combined in an integrated or dispersed state such that functions of the respective constituent elements are directly or indirectly associated with each other to achieve one or more functions. Accordingly, "system" in this specification also includes "apparatus", in which a plurality of constituent elements are integrally combined.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Configuration of Inkjet Printer

Figure 1:
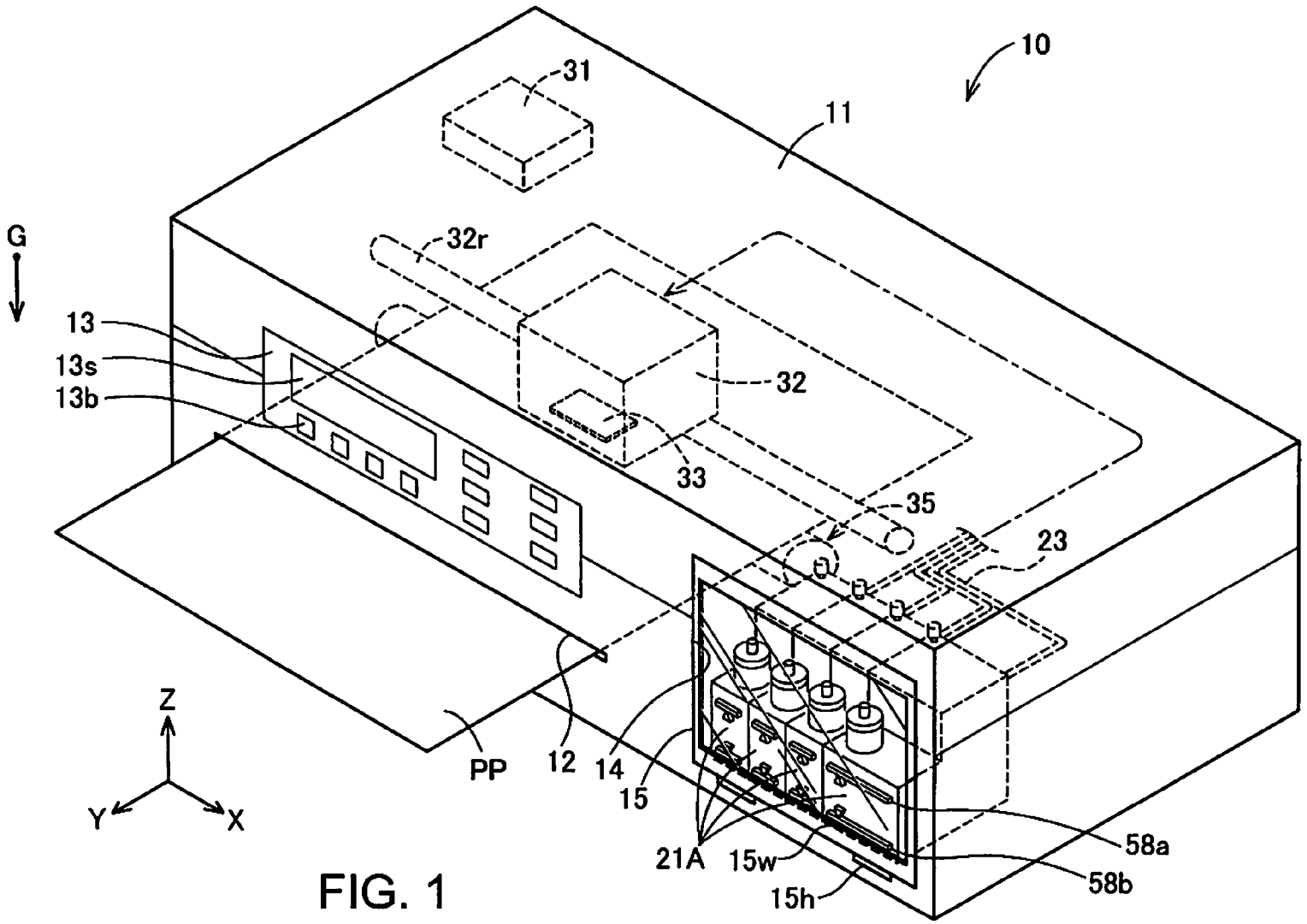
FIG. 1 is a schematic perspective view showing a configuration of an inkjet printer according to a first embodiment.

A configuration of an inkjet printer 10 (hereinafter referred to simply as a "printer 10") according to a first embodiment of the invention will be described with reference to FIGS. 1 and 2. FIG. 1 is a schematic perspective view showing a configuration of the printer 10. FIG. 1 shows the printer 10 in an assumed usual use state (hereinafter referred to simply as a "usual orientation"). In this embodiment, the usual orientation refers to an orientation at the time when the printer 10 is disposed such that a main scanning direction and a sub-scanning direction are parallel with a horizontal plane perpendicular to a gravity direction G. The main scanning direction of the printer 10 is a direction in which a print head 33 moves back and forth when printing is executed. The sub-scanning direction is a direction orthogonal to the main scanning direction, and in which printing paper PP is conveyed at a position where ink is discharged from the print head 33 when printing is executed.

FIG. 1 shows arrows X, Y, and Z, which indicate three orthogonal directions, and an arrow G, which indicates the gravity direction. The arrow X indicates a direction parallel with the main scanning direction, the direction extending from the left side to the right side when a user directly faces a front face of the printer 10. Note that "front face of the printer 10" in this specification refers to a face that is assumed to be directly faced by the user when operating the printer 10 in the usual orientation. The arrow Y indicates a direction parallel with the sub-scanning direction, the direction extending from the back side to the front side of the printer 10. The arrow Z indicates a direction parallel with the gravity direction when the printer 10 is in the usual orientation, and indicates a direction extending upward from below. In the following description, "up/above" and "down/below" respectively mean upward and downward directions that are based on the gravity direction when the printer 10 is in the usual orientation. "Left" and "right" respectively mean leftward and rightward directions when the printer 10 in the usual orientation is directly faced. The arrows G, X, Y, and Z are also shown, as appropriate, in the diagrams referenced in the following description.

The printer 10 is an embodiment of a liquid ejection apparatus according to the invention, and executes printing processing for discharging ink droplets to printing paper PP, which is a print medium, to form an image. The printer 10 includes a casing portion 11, a plurality of ink tanks 21A, a plurality of tubes 23, and a printing portion 30. The casing portion 11 is a resin hollow box created by means of injection molding, and houses the aforementioned ink tanks 21A, tubes 23, and printing portion 30, and the like. The casing portion 11 corresponds to a specific concept of an exterior portion of the liquid ejection apparatus according to the invention.

A face of the casing portion 11 that constitutes the front face of the printer 10 is provided with a paper discharge port 12, an interface portion 13, and an openable lid portion 15. The paper discharge port 12 is an opening portion for discharging the printing paper PP from the inside of the printer 10. The interface portion 13 is a part having operation buttons 13*b* for accepting user operations, and a display unit 13*s* for providing the user with information regarding the printer 10. The openable lid portion 15 is a door portion capable of opening and closing operations that is provided for allowing access to the ink tanks 21A located inside. The openable lid portion 15 is attached, via a hinge mechanism 15*h*, to an opening portion 14 of the casing portion 11 provided on the front side of the ink tank 21A.

Figure 2:
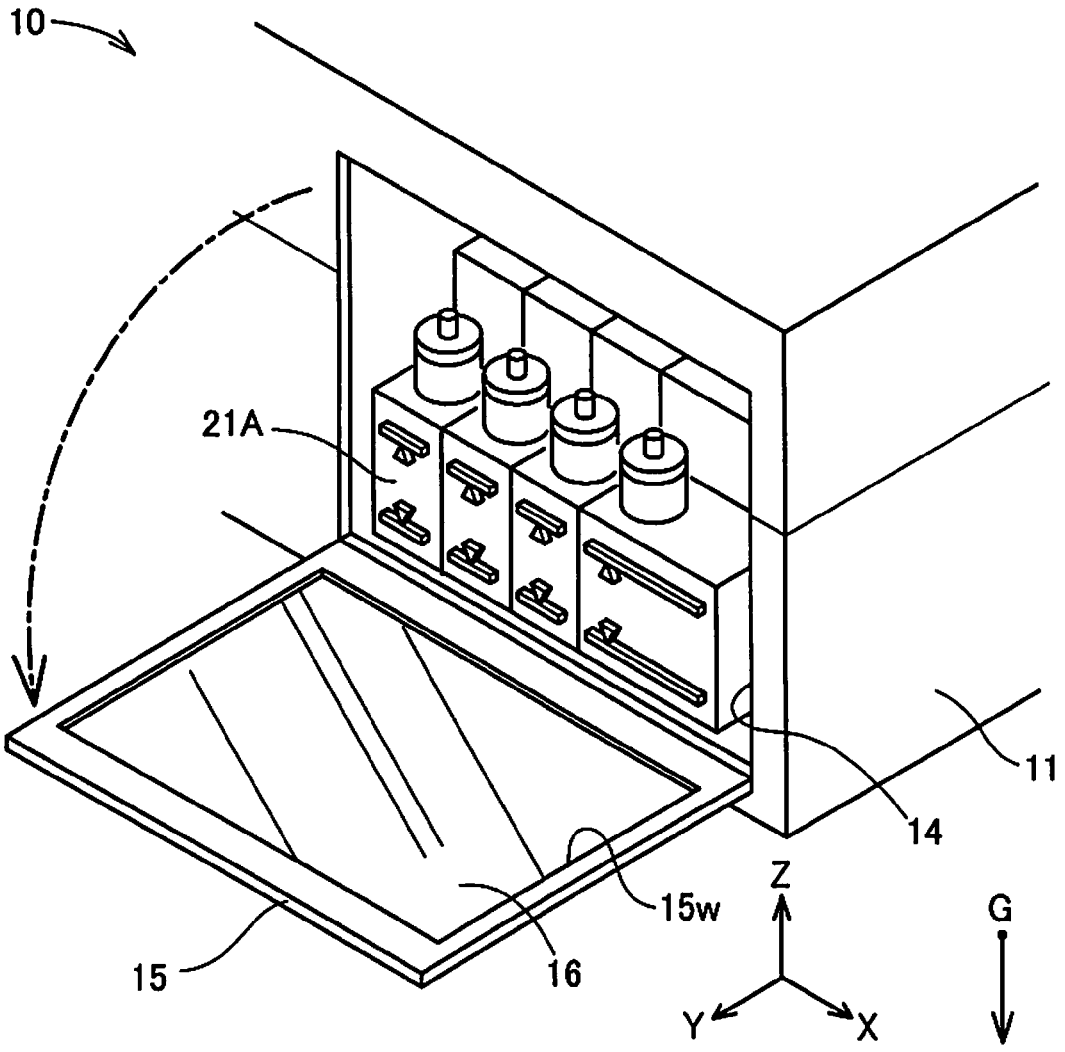
FIG. 2 is a schematic perspective view showing a state where an openable lid portion of the inkjet printer according to the first embodiment is open.

FIG. 2 is a schematic perspective view of the printer 10 in a state where the openable lid portion 15 is open. The openable lid portion 15 is opened and closed in the front face of the printer 10 by being rotationally moved with the hinge mechanism 15*h* (FIG. 1) provided at a lower end as a fulcrum. The user can supply ink to the plurality of ink tanks 21A that are fixed in the casing portion 11 when the openable lid portion 15 is open. The openable lid portion 15 is provided with a window portion 15*w* for enabling the ink tanks 21A to be visually checked from the outside in a state where the openable lid portion 15 is close. A transparent resin plate 16 is attached to the window portion 15*w*. The user can visually check, via a window portion 15*w*, the amount of remaining ink in the ink tanks 21A even in a state where the openable lid portion 15 is close.

The plurality of ink tanks 21A (FIG. 1) are hollow containers for containing ink that is to be supplied to the printing portion 30, and contain ink of different colors. Ink corresponds to a specific concept of liquid according to the invention, and each ink tank 21A corresponds to a specific concept of a tank according to the invention. In this embodiment, four ink tanks 21A, which correspond respectively to ink of four colors, namely cyan, magenta, yellow, and black, are arranged in this order in the arrow X direction at positions directly facing the openable lid portion 15. Note that an ink tank 21A for black ink, which is expected to be consumed more than the ink of the other colors, is configured to be larger in width in the arrow X direction so as to be able to contain a larger amount of ink than each of the ink tanks 21A of the other colors. The ink tank 21A for black ink has roughly the same configuration as the configuration of the ink tanks 21A of the other colors, except that the volume is different. Accordingly, the ink tank 21A for black ink will be described below without being particularly distinguished from the other ink tanks 21A. The configuration of the ink tanks 21A will be described later.

The tubes 23 are flexible resin tubing members. The tubes 23 are connected to the respective ink tanks 21A in one-to-one correspondence. Ink in the ink tanks 21A are supplied to the print head 33 in the printing portion 30 via the tubes 23.

The printing portion 30 includes the print head 33 as well as a control unit 31, a carriage 32, and a paper conveyance mechanism 35. For example, the control unit 31 is constituted by a microcomputer including a central processing unit and a main storage, and exerts various functions by the central processing unit loading various programs into the main storage and executing these programs. In the printer 10, printing processing and various kinds of maintenance processing are executed under the control of the control unit 31.

The carriage 32 is installed so as to be able to move back and forth in the main scanning direction on a conveyance path for the printing paper PP. The driving force is transmitted from a motor (not shown) to the carriage 32 by a pulley (not shown), and the carriage 32 moves back and forth on a rail 32*r* provided so as to span over the conveyance path for the printing paper PP. A plurality of ink storing portions (not shown) for temporarily storing ink are arranged in the main scanning direction on the upper side of the carriage 32, and the print head 33 is attached to the lower side of the carriage 32.

Ink in each ink tanks 21A is supplied to the ink storing portion of corresponding color ink via the tube 23, and is supplied from the ink storing portion to an ink chamber in the print head 33. Note that pumps (not shown or described in detail) for suctioning ink from the ink tanks 21A are provided on an upstream side of the ink storing portions. The print head 33 is provided with nozzles for the respective ink colors for discharging the ink, and discharges ink droplets from the nozzles to a face to be printed of the printing paper PP that is being conveyed, using a known method such as applying a pressure to the ink with a piezo element. The print head 33 corresponds to a specific concept of a liquid ejection head according to the invention.

The paper conveyance mechanism 35 can convey the printing paper PP in the sub-scanning direction by driving the conveyance roller to rotate. When printing is executed, the control unit 31 causes the paper conveyance mechanism 35 to convey the printing paper PP toward the paper discharge port 12 at a predetermined conveyance speed. The control unit 31 then moves the print head 33 back and forth in the main scanning direction, and causes the print head 33 to discharge ink droplets to the face to be printed of the printing paper PP from the nozzles of the print head 33 at a timing that is determined based on printing data.

Configuration of Ink Tank

Figure 3:
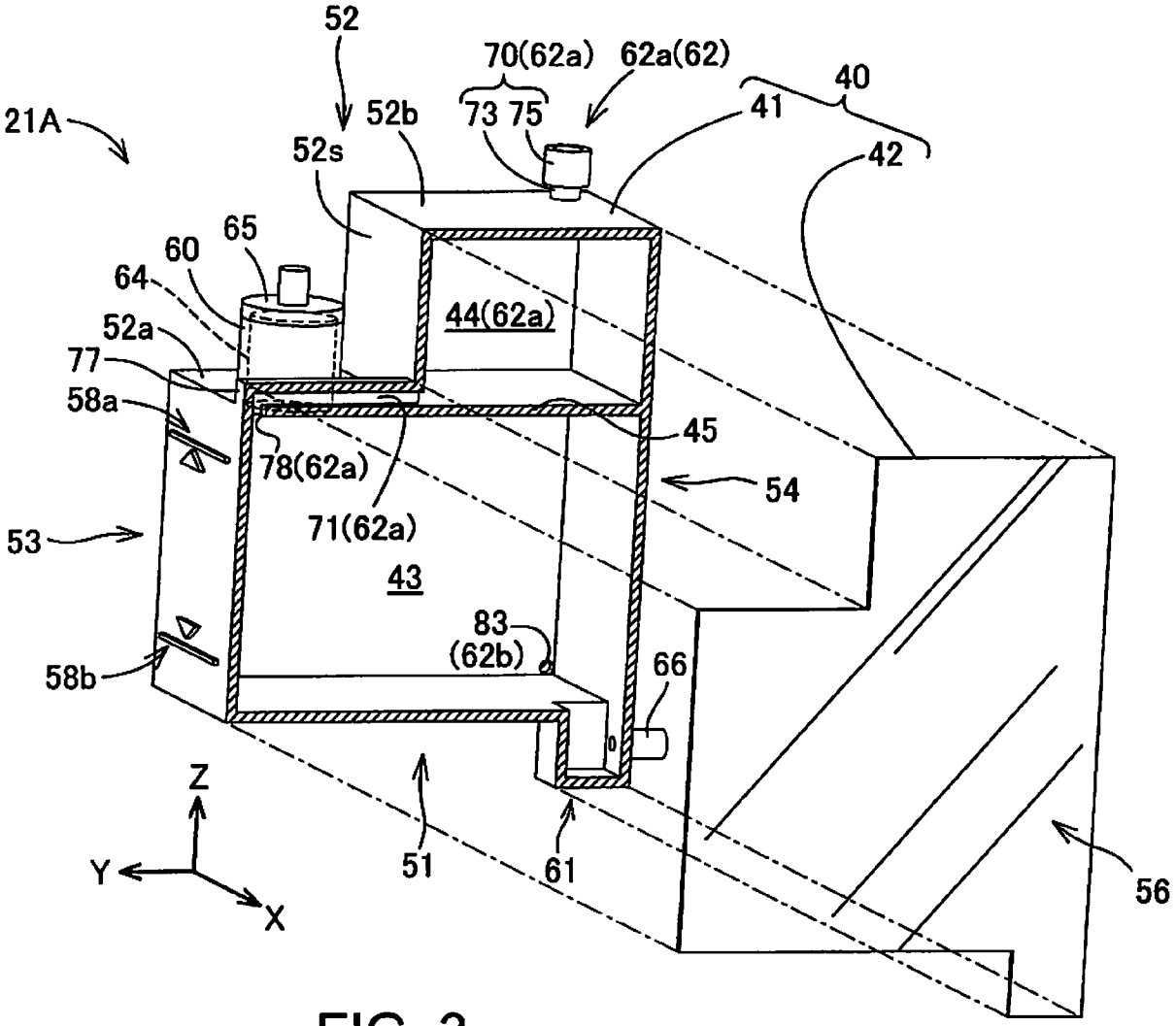
FIG. 3 is a schematic exploded perspective view of the ink tank according to the first embodiment as viewed from a right side face.
Figure 4:
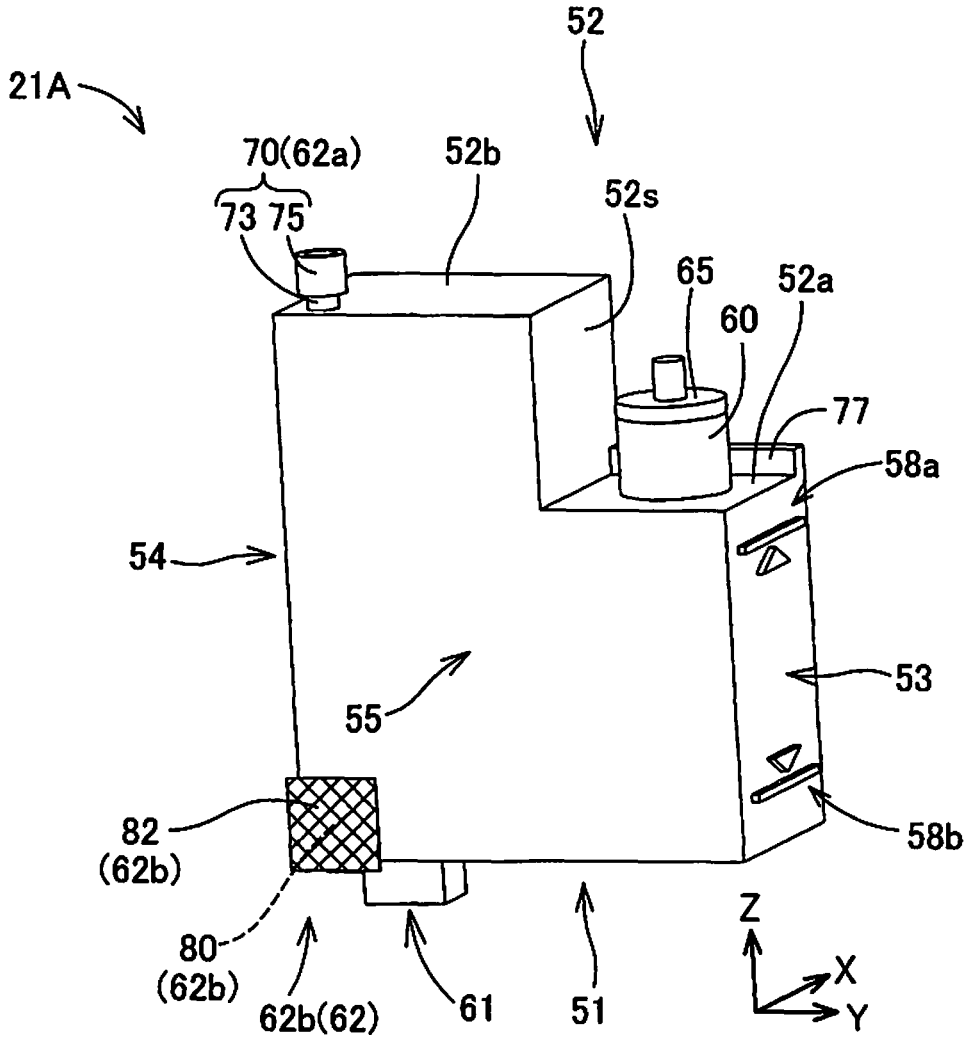
FIG. 4 is a schematic perspective view of the ink tank according to the first embodiment as viewed from a left side face.
Figure 5:
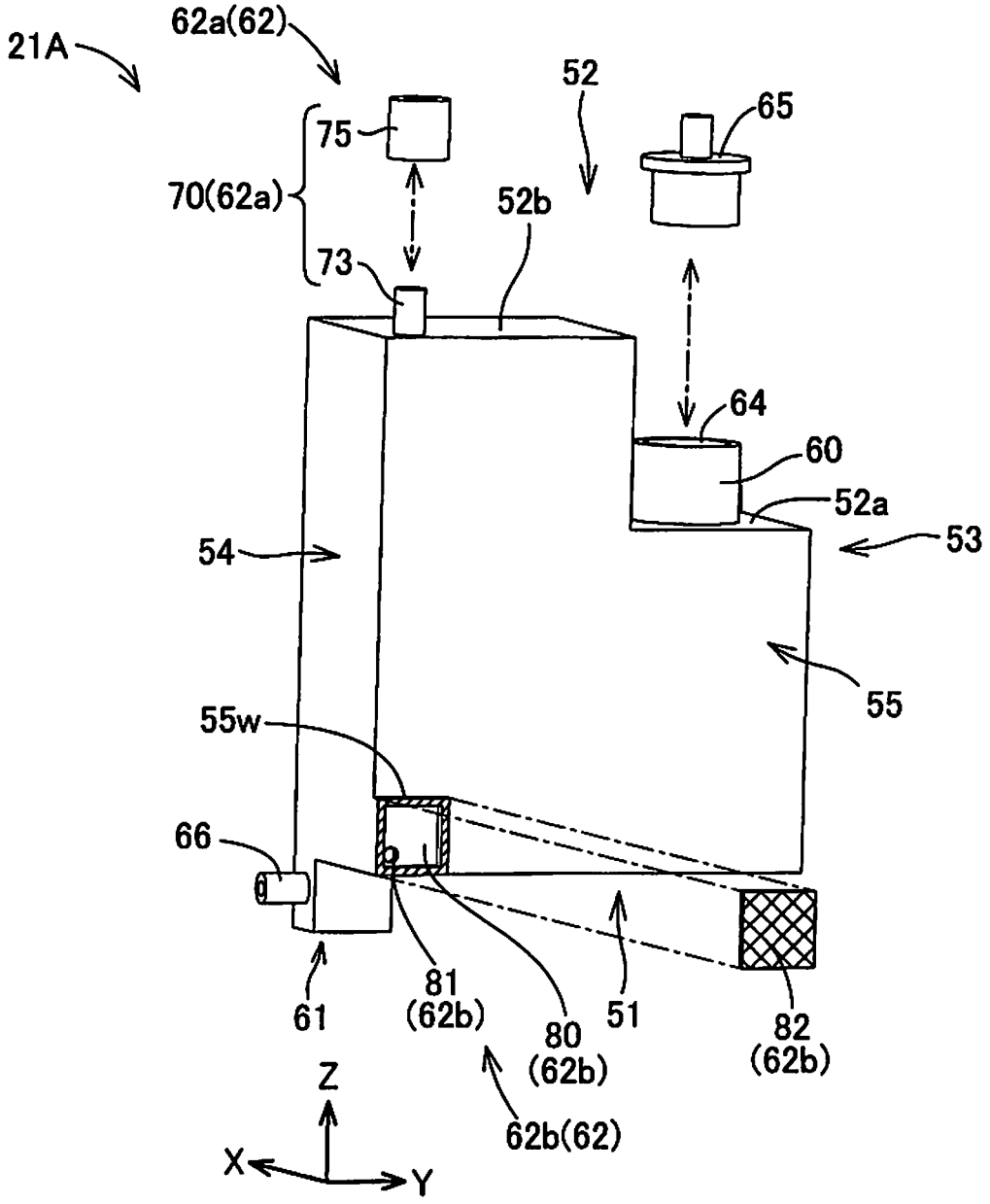
FIG. 5 is a schematic exploded perspective view of the ink tank according to the first embodiment as viewed from a left side face.

A configuration of the ink tank 21A according to the first embodiment will be described with reference to FIGS. 3 to 12 as appropriate. FIG. 3 is a schematic exploded perspective view of the ink tank 21A as viewed from a right side face. FIG. 4 is a schematic perspective view of the ink tank 21A as viewed from a left side face. FIG. 5 is a schematic exploded perspective view of the ink tank 21A as viewed from the left side face. Arrows X, Y, and Z shown in FIGS. 3 to 5 correspond to the above-described directions relative to the printer 10 when the ink tank 21A is fixed to the printer 10. The following description of the ink tank 21A is based on the orientation when being fixed to the printer 10 in the usual orientation. Hereinafter, this orientation will also be called a "first orientation". In this embodiment, the first orientation is also an orientation of the ink tanks 21A when ink is injected into the ink tank 21A by the user, and is also an orientation of the ink tank 21A when ink is supplied to the print head 33 when ink droplets are discharged while printing is executed. A schematic configuration of the main body of the ink tank 21A will be described below, and an ink injection portion 60, an ink supply portion 61, and an air introduction portion 62 provided in the ink tank 21A will be described in this order.

Schematic Configuration of Main Body of Ink Tank

A main body portion 40 of the ink tank 21A is constituted by a case member 41 and a sheet member 42 (FIG. 3). The case member 41 is a hollow resin box that is open over a right side face thereof that is located in the arrow X direction. The case member 41 is created by means of integral molding using nylon or polypropylene, for example. The sheet member 42 is constituted by a flexible resin film member. The sheet member 42 is made of nylon or polypropylene, for example. The sheet member 42 is joined by means of adhesion so as to cover the opening portion on the right side face of the case member 41. In FIG. 3, a part to which the sheet member 42 is joined is hatched with oblique lines.

The main body portion 40 includes two internal spaces 43 and 44 that are arranged above and below. The two internal spaces 43 and 44 have a substantially rectangular parallelepiped shape, and are partitioned from each other by an inner wall portion 45, which extends in two directions, namely the arrow X and Y directions, within the case member 41. "Extending" in this specification means continuously extending in a certain direction. An extending state includes a state of extending in a certain direction and bending in the middle, and a curving state.

A first internal space 43 is located on the lower side of the main body portion 40, and is formed over two directions, namely the arrow X and Y directions, in the main body portion 40. The first internal space 43 has a larger volume than the volume of the second internal space 44. In the ink tank 21A, ink is contained in the first internal space 43. Hereinafter, the first internal space 43 will also be called an "ink containing portion 43". The ink containing portion 43 corresponds to a specific concept of a liquid containing portion according to the invention.

A second internal space 44 is formed above the ink containing portion 43. The width of the second internal space 44 in the arrow Y direction is smaller than the width of the ink containing portion 43 in the arrow Y direction. In this embodiment, the width of the second internal space 44 in the arrow Y direction is roughly half the width of the ink containing portion 43 in the arrow Y direction. Meanwhile, the width of the second internal space 44 in the arrow X direction is roughly the same as that of the ink containing portion 43. Also, in this embodiment, an end position of the second internal space 44 on the back side is roughly aligned with an end position of the ink containing portion 43 on the back side in the arrow Y direction. The air to be introduced into the ink containing portion 43 is contained in the second internal space 44. Hereinafter, the second internal space 44 will also be called an "air chamber 44". The details of the function of the air chamber 44 will be described later.

An outer wall of the ink tank 21A is constituted by six wall portions 51 to 56 that are located in six directions relative to the ink containing portion 43. Note that, in this embodiment, "wall portion" is not limited to a flatly extending portion, and may be curved, or may have a bent portion or a step portion. "Wall portion" may also have, on a surface thereof, a recessed portion, a projecting portion, a groove, an inclined face, or the like. In the following description, two wall portions "intersecting each other" means any of a state where the two wall portions actually intersect each other, a state where one wall portion is located at a position in an extending direction of the other wall portion, and a state where the extending directions of the two wall portions intersect each other. Accordingly, a chamfered portion or the like that constitutes a curved face may lie between the wall portions that intersect each other.

The first wall portion 51 extends in two directions, namely the arrow X and Y directions, below the ink containing portion 43, and constitutes a bottom face of the ink tank 21A and also constitutes a bottom wall portion of the ink containing portion 43 (FIGS. 3 to 5). The first wall portion 51 is disposed along a horizontal plane in the first orientation. The second wall portion 52 extends in two directions, namely the arrow X and Y directions, above the ink containing portion 43, and constitutes an upper face of the ink tank 21A. The second wall portion 52 is located at a position opposing the first wall portion 51 with the ink containing portion 43 and the air chamber 44 therebetween, and is located above the first wall portion 51 in the first orientation. In this specification, "opposing" includes a state where objects directly face each other, and a state where objects indirectly face each other with other things therebetween.

In this embodiment, the second wall portion 52 has two parts 52*a* and 52*b*, and a step portion 52*s*. The two parts 52*a* and 52*b* are located at different heights while sandwiching the step portion 52*s*. A first part 52*a* is located on the front side of the printer 10, and is located at a lower position than a second part 52*b*. The first part 52*a* constitutes an upper wall portion of the ink containing portion 43 together with the inner wall portion 45. The second part 52*b* is located on the back side of the first part 52*a*, and constitutes an upper wall portion of the air chamber 44. The step portion 52*s* constitutes a wall portion on the front side of the air chamber 44.

The third wall portion 53 constitutes a wall portion on the front side of the ink containing portion 43, and constitutes a front face of the ink tank 21A disposed on the front side of the printer 10. The third wall portion 53 extends in two directions, namely the arrow X and Z directions on the front side of the ink containing portion 43, and intersects the first wall portion 51 and the first part 52*a* of the second wall portion 52. The fourth wall portion 54 constitutes a back face of the ink tank 21 A disposed on the back side of the printer 10. The fourth wall portion 54 constitutes a wall portion on the back side of the ink containing portion 43 and the air chamber 44. The fourth wall portion 54 extends in two directions, namely the arrow X and Z directions on the back side of the ink containing portion 43 and the air chamber 44, and is located at a position opposing the third wall portion 53 with the ink containing portion 43 therebetween. The fourth wall portion 54 intersects the first wall portion 51 and the second part 52*b* of the second wall portion 52.

The fifth wall portion 55 constitutes a left side face of the ink tank 21A, and constitutes a side wall portion on the left side of the ink containing portion 43 and the air chamber 44 (FIGS. 4 and 5). The fifth wall portion 55 extends in two directions, namely the arrow Y and Z directions, and intersects the first wall portion 51, the second wall portion 52, the third wall portion 53, and the fourth wall portion 54. The sixth wall portion 56 is constituted by the aforementioned sheet member 42 (FIG. 3). The sixth wall portion 56 constitutes a right side face of the ink tank 21A, and constitutes a side wall portion on the right side of the ink containing portion 43 and the air chamber 44. The sixth wall portion 56 opposes the fifth wall portion 55 with the ink containing portion 43 and the air chamber 44 therebetween, and extends in two directions, namely the arrow Y and Z directions. The sixth wall portion 56 intersects the first wall portion 51, the second wall portion 52, the third wall portion 53, and the fourth wall portion 54.

In this embodiment, among the five wall portions 51 to 55 constituting the case member 41, at least the third wall portion 53 is configured to be transparent or translucent such that the liquid surface of the ink contained in the ink containing portion 43 can be visually checked. In the ink tank 21A, the third wall portion 53 functions as a visual check portion through which the user visually checks the position of the liquid surface of the ink.

The third wall portion 53 is provided with two mark portions 58*a* and 58*b*, which are projecting portion on the wall surface. A first mark portion 58*a* indicates an upper limit position of the liquid surface of ink that is defined in advance in the ink containing portion when the ink tank 21A is in the first orientation. The first mark portion 58*a* corresponds to a specific concept of an upper limit index portion according to the invention. A second mark portion 58*b* indicates a lower limit position of the liquid surface of ink in the ink containing portion 43 when the ink tank 21A is in the first orientation. The two mark portions 58*a* and 58*b* are provided at positions at which the user who is directly facing the printer 10 can visually check the mark portions 58*a* and 58*b* via the window portion 15*w* of the printer 10 (FIG. 1). Note that both or at least one of the two mark portions 58*a* and 58*b* may be omitted. The mark portions 58*a* and 58*b* may not be formed as projecting portions on the wall surface, and may be formed by seals or prints, for example.

Ink Injection Portion

The ink injection portion 60 is a part for receiving ink injected into the ink containing portion 43 from the outside (FIGS. 3 to 5). The ink injection portion 60 has a through hole 64, which is in communication with the ink containing portion 43. The user of the printer 10 can supply ink to the ink containing portion 43 via the ink injection portion 60 in a state where the ink tank 21A is fixed to the printer 10 in the usual orientation. The ink injection portion 60 corresponds to a specific concept of a liquid injection portion according to the invention.

In this embodiment, the ink injection portion 60 is configured to be a cylindrical part that projects upward in the first part 52*a* of the second wall portion 52. In the printer 10 according to this embodiment, the ink injection portion 60 is provided on the front side of the ink tank 21A, and the accessibility to the ink injection portion 60 for the user is thus improved. An upper end of the ink injection portion 60 is located at a lower position than the step portion 52*s* of the second wall portion 52 that is located on the back side. For this reason, when the ink is injected via the ink injection portion 60, the ink sputtering in a direction toward the distal side of the printer 10 is suppressed by the step portion 52*s*.

A cap member 65 is fitted into an upper opening end portion of the through hole 64 of the ink injection portion 60 (FIGS. 4 and 5). The cap member 65 is detachably attached to the ink injection portion 60. When printing is executed in the printer 10, usually, the cap member 65 is attached to the ink injection portion 60 such that the ink injection portion 60 is sealed in an airtight manner. When ink is injected into the ink containing portion 43 via the ink injection portion 60, the cap member 65 is removed from the ink injection portion 60. The cap member 65 corresponds to a specific concept of a sealing member according to the invention. In this embodiment, the cap member 65 is constituted by a flexible resin portion. The cap member 65 is created by integral molding using nylon or polypropylene, for example. As a result of the cap member 65 being flexible, sealability thereof with respect to the ink injection portion 60 is improved.

In this embodiment, the cap member 65 is configured to not come off of the ink injection portion 60 until receiving a predetermined limit pressure from the inside of the ink containing portion 43. It is favorable that the predetermined limit pressure for the cap member 65 is greater than or equal to the limit pressure for the tube 23 (FIG. 1). The limit pressure for the tube 23 (FIG. 1) is a limit value of the internal pressure of the ink tank 21A under which the tube 23 (FIG. 1) comes off of a connection tubing portion 66 of the ink supply portion 61 in the ink tank 21A. The predetermined limit pressure for the cap member 65 may be 20 kPa or greater, for example. The cap member 65 may be attached to the ink injection portion 60 by means of a screw, for example. This configuration suppresses the cap member 65 coming off of the ink injection portion 60 even when the environment where the printer 10 is disposed changes and the pressure in the ink tank 21A increases accordingly, as described later. Accordingly, leakage of the ink from the ink injection portion 60 that has been opened unintentionally is suppressed.

Ink Supply Portion

The ink supply portion 61 is a connection portion that connects the ink containing portion 43 to the tube 23 (FIGS. 3 to 5). Ink contained in the ink containing portion 43 is supplied from the ink supply portion 61 to the print head 33 in the printing portion 30 via the tube 23. In this embodiment, the ink supply portion 61 is provided at an end of the first wall portion 51 on the back side. The ink supply portion 61 is formed as a hollow part projecting downward from the ink containing portion 43. The ink supply portion 61 is provided with the connection tubing portion 66 to which the tube 23 is connected. The connection tubing portion 66 has a substantially cylindrical shape extending in the direction opposite to the arrow Y direction, and the tube 23 is fitted to the connection tubing portion 66 in the arrow Y direction.

Air Introduction Portion

The air introduction portion 62 is a part through which the outside and the ink containing portion 43 are in communication such that the air outside the ink tank 21A can be introduced into the ink containing portion 43 (FIGS. 3 to 5). The air introduction portion 62 has a first air introduction portion 62*a* (FIG. 3) and a second air introduction portion 62*b* (FIGS. 4 and 5) that constitute separate air distribution passages such that an air distribution passage for the ink containing portion 43 is formed in even when the ink tank 21A is in an orientation other than the first orientation. In the ink tank 21A, even if the ink tank 21A is caused to be in various orientations when disposed in a state where a predetermined amount of ink is contained in the ink containing portion 43, an air distribution passage for the ink containing portion 43 is formed by at least one of the first air introduction portion 62*a* and the second air introduction portion 62*b*. Usually, when printing is executed in the printer 10 and the ink in the ink containing portion 43 is consumed, the air is introduced into the ink containing portion 43 via the first air introduction portion 62*a*. The second air introduction portion 62*b* forms an air distribution passage for the ink containing portion 43 when the first air introduction portion 62*a* is in an orientation in which the first air introduction portion 62*a* is blocked by the ink. Configurations of the first air introduction portion 62*a* and the second air introduction portion 62*b* will be described below in this order, and subsequently, air distribution passages formed by the air introduction portion 62 when the ink tank 21A is in various orientations will be described.

First Air Introduction Portion

The first air introduction portion 62*a* is constituted by an air intake port portion 70, the aforementioned air chamber 44, and an air passage portion 71 (FIG. 3). The air intake port portion 70 is a part through which the outside of the ink tank 21A and the air chamber 44 are in communication such that the air can be taken into the air chamber 44. In this embodiment, the air intake port portion 70 is provided so as to project upward from the second part 52*b* of the second wall portion 52. The air intake port portion 70 is located in a region on the back side in the second part 52*b* of the second wall portion 52, closer to the fourth wall portion 54 than to the step portion 52*s*. The air intake port portion 70 is located in a region on the left side in the second part 52*b* of the second wall portion 52, closer to the fifth wall portion 55 than to the sixth wall portion 56. The air intake port portion 70 has a tubing portion 73 and a ventilation cap member 75 (FIGS. 4 and 5). The tubing portion 73 is a substantially cylindrical part extending upward from the second part 52*b* of the second wall portion 52, and has a through hole in communication with the air chamber 44.

Figure 6:
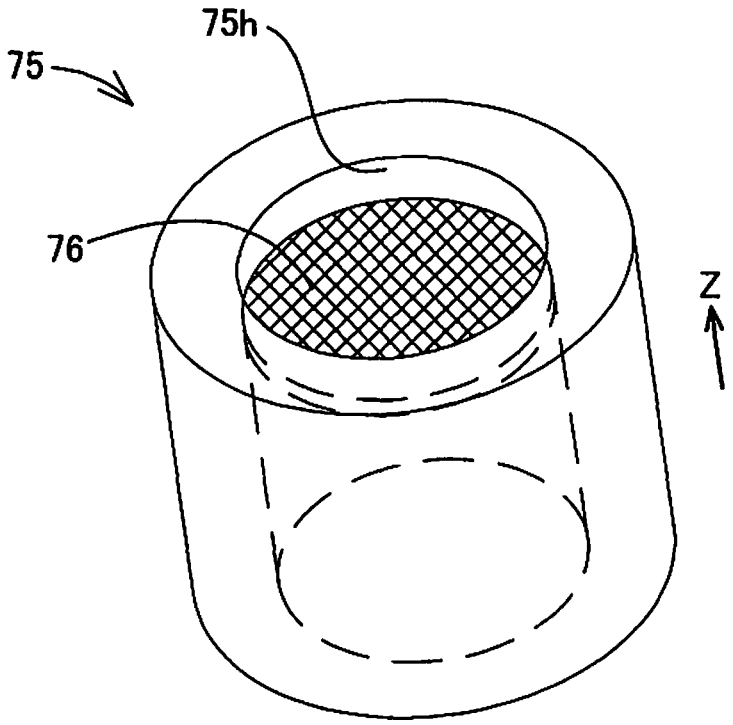
FIG. 6 is a schematic perspective view showing a ventilation cap member according to the first embodiment.

FIG. 6 is a schematic perspective view showing a configuration of the ventilation cap member 75. The ventilation cap member 75 is a substantially cylindrical member, and a filter member 76 is attached to the inside of a cylindrical hole 75*h*. The filter member 76 is constituted by a member that allows gas to pass through the inside thereof and suppress liquid passing through the inside. The filter member 76 is constituted by a water-permeable, moisture-proof member, such as Gore-Tex®, or a steam separating member in which water-repellent porous members are laminated, for example. In this embodiment, the filter member 76 is configured to be a disk-shaped film member. The overall outer periphery of the filter member 76 is joined to the inner-circumferential face of the cylindrical hole 75*h* so as to block the cylindrical hole 75*h*.

The ventilation cap member 75 is attached to the tubing portion 73 in an airtight manner in a state where the inner-circumferential face of the ventilation cap member 75 is closely fitted to the outer-circumferential face of the tubing portion 73 at the upper end (FIGS. 4 and 5). In this embodiment, the ventilation cap member 75 is detachably attached to the tubing portion 73. When the ventilation cap member 75 is attached to the tubing portion 73, the filter member 76 is disposed in a fixed manner so as to block an opening end portion of the tubing portion 73. In the ink tank 21A, as a result of the air intake port portion 70 being provided with the filter member 76, leakage of the ink that has flown into the air chamber 44 to the outside via the air intake port portion 70 is suppressed. The filter member 76 corresponds to a specific concept of a first member according to the invention.

In this embodiment, as mentioned above, the ventilation cap member 75 is detachable from the tubing portion 73. Accordingly, even if, for example, the filter member 76 is clogged, replacement thereof is easy, and the maintainability of the printer 10 is thus improved. In this embodiment, the ventilation cap member 75 is configured to not come off of the tubing portion 73 until the filter member 76 receives, from the ink in the ink tank 21A, a pressure greater than or equal to the limit pressure for the tube 23 under which the tube 23 (FIG. 1) comes off of the ink supply portion 61. The reason therefor will be described later.

The air passage portion 71 connects the air chamber 44 and the ink containing portion 43. The air passage portion 71 is provided in a protruding portion 77, which is provided in the first part 52*a* of the second wall portion 52. The protruding portion 77 is a wall portion that protrudes upward in a right end portion of the first part 52*a* and extends over the arrow Y direction. In this embodiment, the air passage portion 71 is formed as a passage groove extending over the arrow Y direction in a face on the right side of the protruding portion 77. The air passage portion 71 is connected to a lower end of the air chamber 44 on the front right side. Also, the air passage portion 71 is connected to an upper end of the ink containing portion 43 on the front right side. In the ink containing portion 43, a communication port 78, which serves as an entrance and exit of the air passage portion 71, is open downward. The communication port 78 corresponds to a specific concept of a first air introduction port according to the invention. The air passage portion 71 is configured to have a flow path resistance that is at least greater than or equal to that of the air chamber 44 such that the ink flowing into the air chamber 44 is suppressed.

When the ink tank 21A is in the first orientation, in the first air introduction portion 62*a*, the air that has passed through the filter member 76 of the air intake port portion 70 flows into the air chamber 44, then flows through the air passage portion 71, and flows into the ink containing portion 43 via the communication port 78. In the first air introduction portion 62*a*, an air flow path constituted by the air intake port portion 70, the air chamber 44, and the air passage portion 71 corresponds to a specific concept of a first air flow path according to the invention.

When the ink tank 21A is in an orientation obtained by rotating the ink tank 21A from the first orientation, the ink in the ink containing portion 43 flows into the air chamber 44 via the air passage portion 71 in some cases. Even in such cases, in the ink tank 21A, a certain amount of ink is stored in the air chamber 44. Accordingly, the ink reaching the filter member 76 is suppressed, and clogging, deterioration, or the like of the filter member 76 is suppressed. In particular, in this embodiment, the air intake port portion 70 is located in the upper face of the air chamber. Accordingly, the ink reaching the filter member 76 is further suppressed. The air chamber corresponds to a specific concept of a first liquid containing chamber according to the invention.

In this embodiment, the first air introduction port 62*a* is provided in an upper stage of the ink containing portion 43. In the first orientation, the communication port 78 in the first air introduction portion 62*a* is located above the first mark portion 58*a*. Accordingly, when the user supplies ink, the ink being injected to an extent that the ink flows into the first air introduction portion 62*a* is suppressed.

Second Air Introduction Portion

The second air introduction portion 62*b* is provided at a lower end portion in the left side face of the ink tank 21A (FIGS. 4 and 5). As described later, the second air introduction portion 62*b* enables the air to be introduced into the ink containing portion 43 in an orientation in which the first air introduction port 62*a* is blocked by the ink. The second air introduction portion 62*b* has a buffer chamber 80, a communicating path 81, and a filter member 82 (FIG. 5). In this embodiment, the buffer chamber 80 is located at a corner portion at a lower end portion of the fifth wall portion 55. The buffer chamber 80 is constituted by a space surrounded by a wall portion 55*w*, which is formed as a projecting portion on a rib on the outer surface of the fifth wall portion 55.

The buffer chamber 80 is connected to the ink containing portion 43 via the communicating path 81. The communicating path 81 is constituted by a through hole that passes through the fifth wall portion 55 in a lower end portion within the buffer chamber 80 on the back side (i.e. the fourth wall portion 54 side). A communication port 83, which is an entrance and exit of the communicating path 81, is open in the ink containing portion 43 (FIG. 3). The buffer chamber 80 is sealed by the filter member 82 being joined to an end face of the wall portion 55*w* (FIG. 5).

The filter member 82 is constituted by a member that allows gas to pass through the inside and suppresses liquid passing through the inside thereof, similar to the filter member 76 provided in the first air introduction portion 62*a*. The filter member 82 may be constituted by the same material as that of the filter member 76 in the first air introduction portion 62*a*, or may be constituted by a different kind of material. The filter member 82 corresponds to a specific concept of a second member according to the invention.

When the ink tank 21A is in the first orientation with the ink contained in the ink containing portion 43, the ink flows into the buffer chamber 80 via the communication port 83. The ink that has flown into the buffer chamber 80 is dammed up by the filter member 82, and is stored in the buffer chamber 80. Note that, in this embodiment, the filter member 82 is joined to the wall portion 55*w* as mentioned above. Accordingly, coming-off of the filter member 82 is suppressed even in a state where the buffer chamber 80 is filled with the ink.

When the ink tank 21A is in an orientation in which the first air introduction portion 62*a* is blocked by ink, e.g., in an orientation obtained by vertically inverting the first orientation, the ink in the buffer chamber 80 flows out into the ink containing portion 43. As a result, the air can flow into the buffer chamber 80 via the filter member 82, and the air that has flown into the buffer chamber 80 passes through the communicating path 81 and is introduced into the ink containing portion 43 via the communication port 83. The communication port 83 in the second air introduction portion 62*b* corresponds to a specific concept of a second air introduction port according to the invention. Also, in the second air introduction portion 62*b*, the air flow path constituted by the buffer chamber 80 and the communicating path 81 corresponds to a specific concept of the second air flow path according to the invention, and the buffer chamber 80 corresponds to a specific concept of a second liquid containing chamber according to the invention.

Air Distribution Passage When the Ink Tank is in Various Orientations

FIGS. 7 to 12 shows exemplary states where the ink tank 21A in which ink IK is contained in the ink containing portion 43, the amount of the ink IK being roughly half the volume of the ink containing portion 43, is in various orientations. Note that, in this embodiment, FIGS. 7 to 12 omit the sheet member 42, which serves as the sixth wall portion 56, the mark portions 58*a* and 58*b* on the third wall portion 53, and the tube 23 connected to the ink supply portion 61, for the sake of convenience. FIGS. 7 to 12 also show a two-directional arrow AP, which indicates inflow and outflow of the air with respect to the ink tank 21A.

For example, when the printer 10 is carried from a place that satisfies environmental conditions assumed at the time of shipping from the factory to a place where the temperature is significantly high, or a place where the altitude is high and the atmospheric pressure is low, for example, there is a possibility that the air in the ink tank 21A expands. With the ink tank 21A according to this embodiment, even if the ink tank 21A is in various orientations when disposed with the ink IK contained in the ink tank 21A, an air distribution passage is formed by the first air introduction portion 62*a* or the second air introduction portion 62*b*, as described below. For this reason, the ink tank 21A entering a sealed state is suppressed when the ink tank 21A is in an orientation that is different from the usual orientation at the time of carriage of the printer 10 that may cause the aforementioned change in the environment when the printer 10 is disposed. Accordingly, an increase in the pressure in the ink tank 21A due to expansion of the air in the ink tank 21A is suppressed, and the ink IK in the ink tank 21A being pushed to the outside is suppressed.

Figure 7:
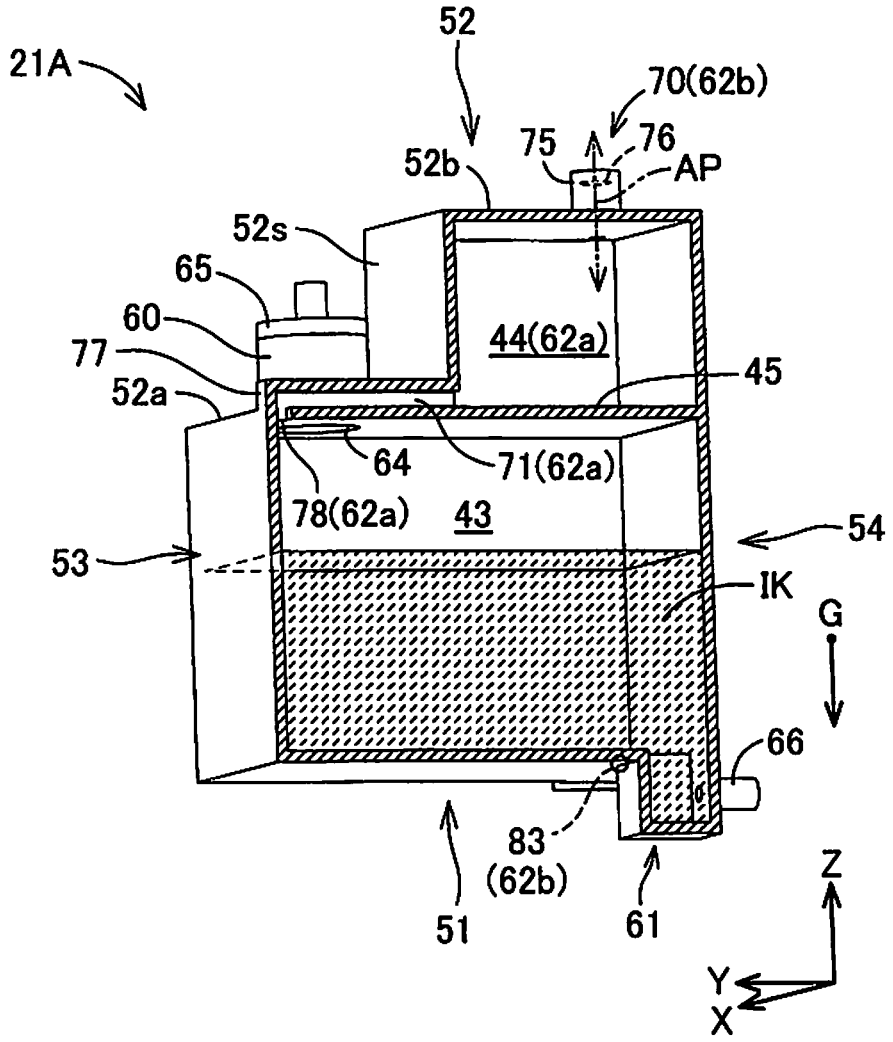
FIG. 7 is a schematic perspective view of an ink tank according to the first embodiment when the ink tank is in a first orientation.

FIG. 7 shows the ink tank 21A in the first orientation. When the ink tank 21A is in the first orientation, the communication port 78 in the first air introduction portion 62*a* is located in a region where the air exists, and the communication port 83 in the second air introduction portion 62*b* is located in a region where the ink IK exists. Therefore, an air distribution passage for the ink tank 21A is formed by the first air introduction portion 62*a* as mentioned above. In the first orientation, the air in the ink tank 21A can escape from the first air introduction portion 62*a* to the outside. Accordingly, even in a case where the air expands in the ink tank 21A, the ink IK in the ink containing portion 43 being pressed out to the ink supply portion 61 or the second air introduction portion 62*b* is suppressed. Accordingly, in the printer 10 in the first orientation, leakage of the ink IK is suppressed.

Figure 8:
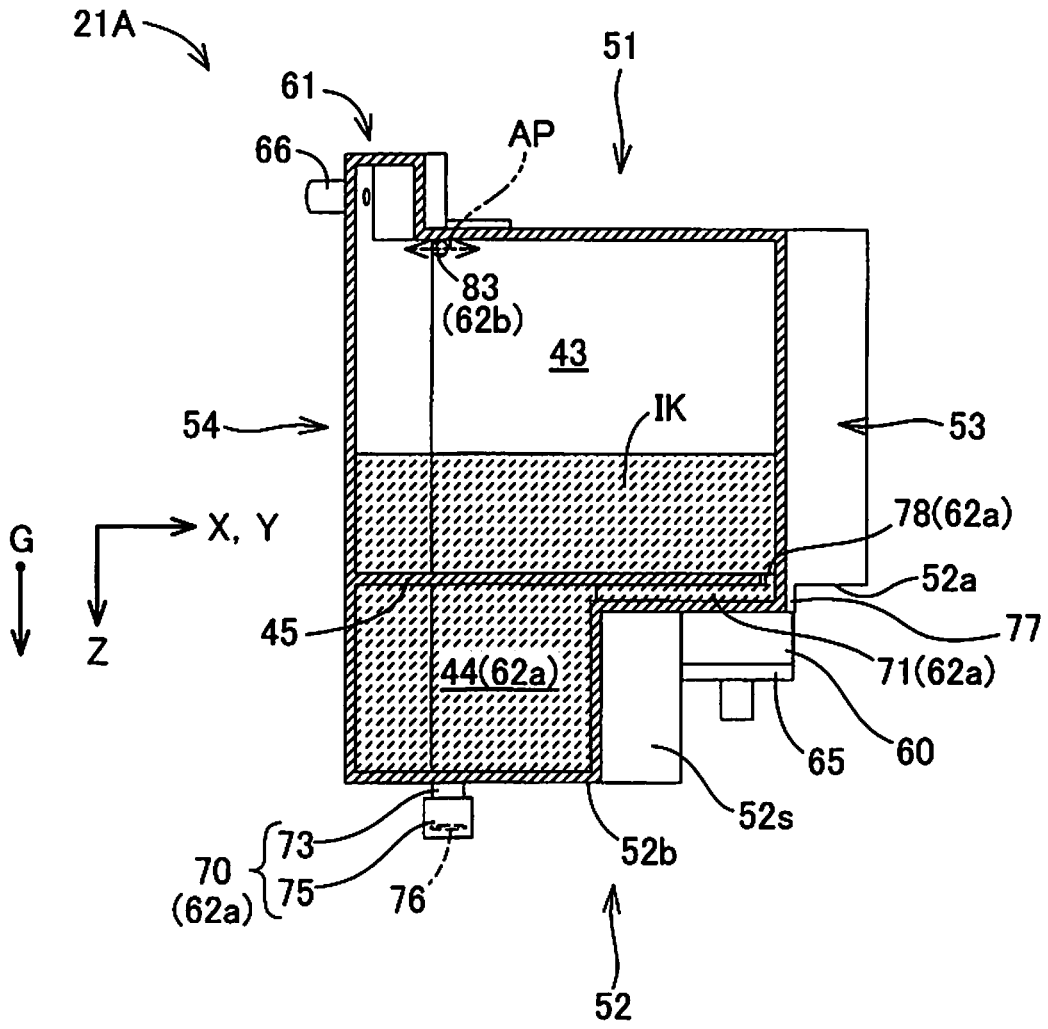
FIG. 8 is a schematic perspective view of the ink tank according to the first embodiment when the ink tank is in a second orientation.

FIG. 8 shows the ink tank 21A in a second orientation. "Second orientation" refers to an orientation obtained by vertically inverting the ink tank 21A from the first orientation by 180 degrees, with the second wall portion 52 disposed along a horizontal plane, and with the first wall portion 51 disposed above the second wall portion 52. When the ink tank 21A is in the second orientation, in the ink containing portion 43, the air exists on the first wall portion 51 side, and the ink IK exists on the second wall portion 52 side. Therefore, the communication port 78 in the first air introduction portion 62*a* is located in a region where the ink IK exists, and the communication port 83 in the second air introduction portion 62*b* is located in a region where the air exists.

In the second orientation, a part of the ink IK in the ink containing portion 43 flows into the air chamber 44 via the air passage portion 71 and is stored in the air passage portion 71 and the air chamber 44. Leakage of the ink IK in the air chamber 44 to the outside is suppressed by the filter member 76 in the first air introduction portion 62*a*. Meanwhile, the air distribution passage for the ink containing portion 43 is formed by the second air introduction portion 62*b*. Therefore, even when the ink tank 21A is kept in the second orientation and placed in an environment where the air in the ink tank 21A expands, the ink IK in the ink containing portion 43 being pushed out to the ink injection portion 60 or the first air introduction portion 62*a* due to expansion of the air is suppressed. Accordingly, in the printer 20 in the second orientation, leakage of the ink IK is suppressed.

In this embodiment, the ventilation cap member 75 is configured to not come off of the tubing portion 73 until the filter member 76 in the first air introduction portion 62*a* receives a pressure greater than or equal to the limit pressure for the tube 23 from the ink IK, as mentioned above. This configuration suppresses, in the second orientation, the ventilation cap portion 75 coming off prior to the tube 23 due to expansion of the air in the ink containing portion 43, even if the filter member 82 in the second air introduction portion 62*b* is clogged and the air permeability has degraded. Also, in this embodiment, the cap member 65 attached to the ink injection portion 60 also has withstand pressure performance that is similar to that of the ventilation cap member 75, as mentioned above. Accordingly, in the second orientation, the cap member 65 coming off of the ink injection portion 60 as a result of receiving the pressure of the ink IK is suppressed, similar to the ventilation cap member 75.

Figure 9:
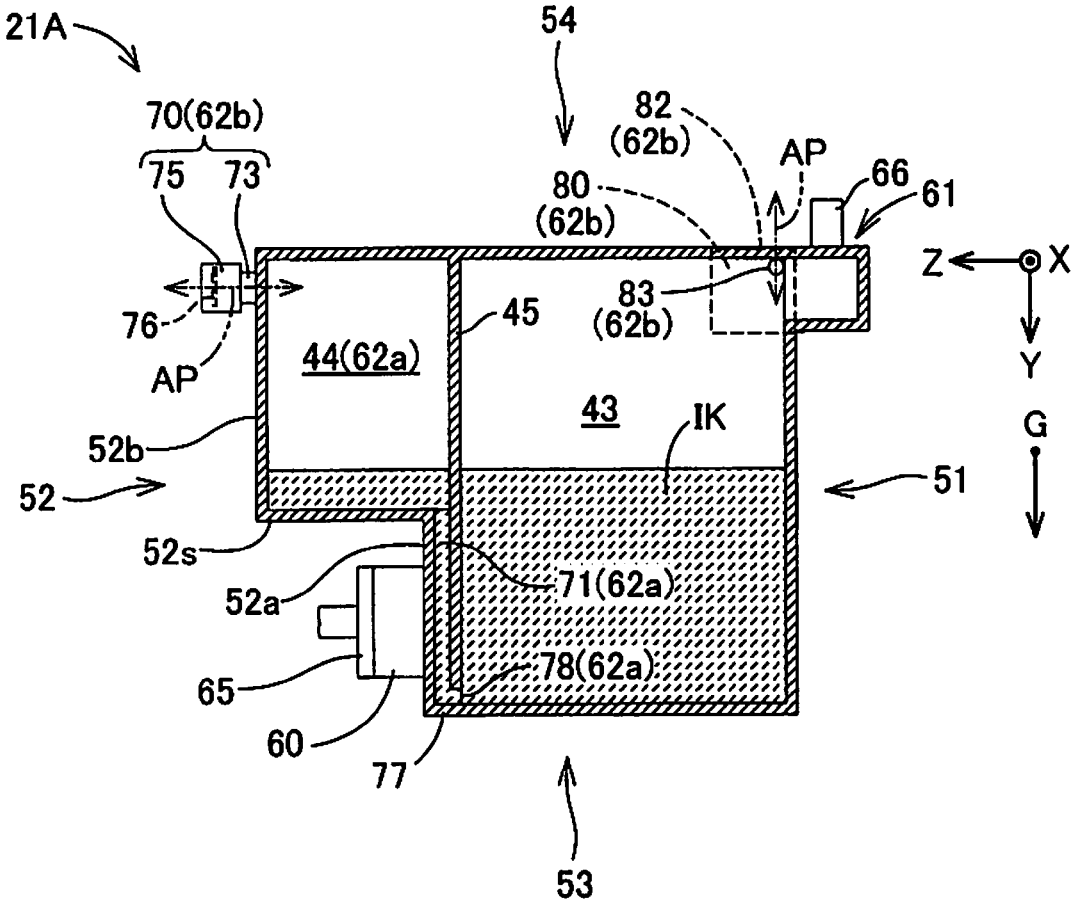
FIG. 9 is a schematic perspective view of the ink tank according to the first embodiment when the ink tank is in a third orientation.

FIG. 9 shows the ink tank 21A in a third orientation. "Third orientation" refers to an orientation obtained by rotating the ink tank 21A from the first orientation to the front side by 90 degrees, with the third wall portion 53 disposed along a horizontal plane, and with the fourth wall portion 54 located above the third wall portion 53. In the ink containing portion 43 when the ink tank 21A is in the third orientation, the communication port 78 in the first air introduction portion 62*a* is in a state of being clogged by the ink IK, and the communication port 83 in the second air introduction portion 62*b* is located in a region where the air exists. In the third orientation, an air distribution passage for the ink containing portion 43 is formed by the second air introduction portion 62*b*, and the ink IK being pushed out by the expansion of the air in the ink containing portion 43 is suppressed.

Also, in this embodiment, in the third orientation, the air intake port portion 70 is located in a region where the air on the upper side of the air chamber 44 exists, and an air distribution passage between the outside and the air chamber 44 is formed by the air intake port portion 70. Accordingly, even if the air in the ink containing portion 43 has expanded in a state where the air permeability of the filter member 82 in the second air introduction portion 62*b* has lowered, the ink IK in the ink containing portion 43 can escape into the air chamber 44. Therefore, the cap member 65 in the ink injection portion 60 receiving a pressure from the ink IK in the ink containing portion 43 is suppressed. Accordingly, the cap member 65 coming off unexpectedly is suppressed.

In addition, in this embodiment, the air chamber 44 is located at a position close to the back side. Therefore, in the third orientation, the amount of the ink IK flowing into the air chamber 44 is suppressed, and the ink IK reaching the air intake port portion 70 is suppressed.

Figure 10:
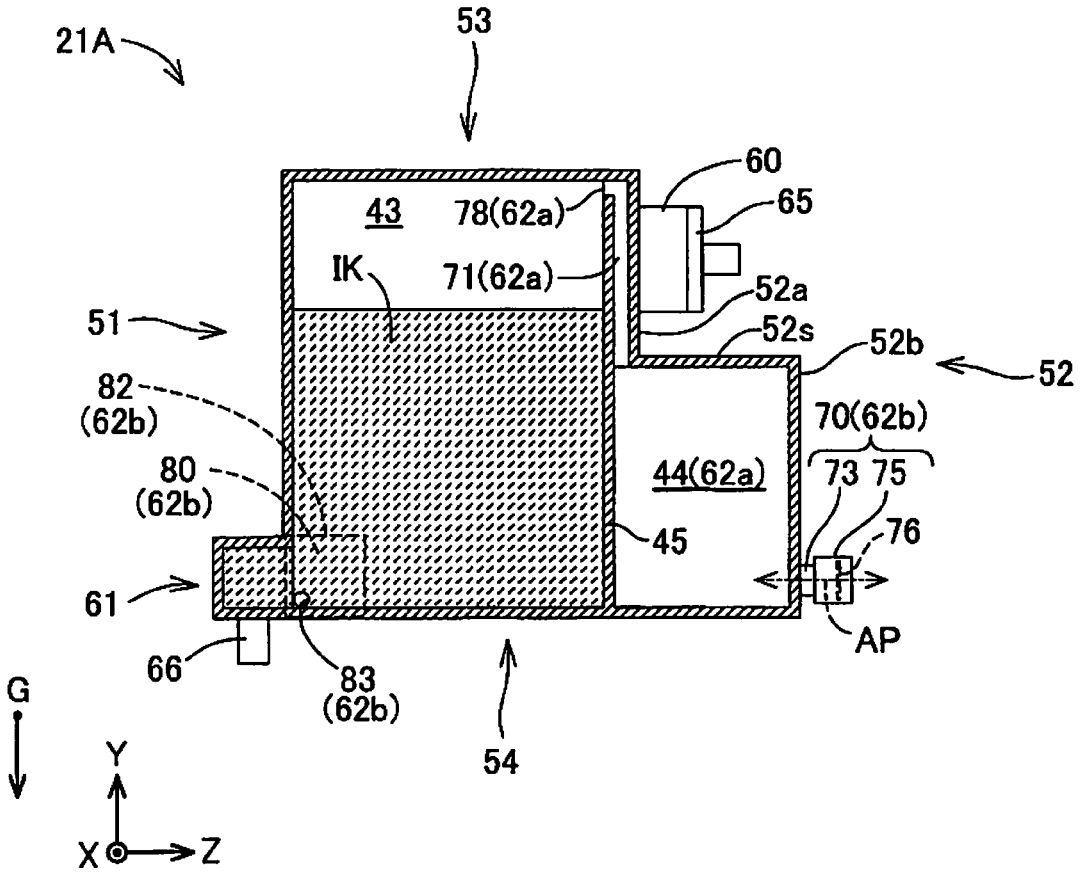
FIG. 10 is a schematic perspective view of the ink tank according to the first embodiment when the ink tank is in a fourth orientation.

FIG. 10 shows the ink tank 21A in a fourth orientation. "Fourth orientation" refers to an orientation obtained by rotating the ink tank 21A from the first orientation to the back side by 90 degrees, with the fourth wall portion 54 disposed along a horizontal plane, and with the third wall portion 53 located above the fourth wall portion 54. In the ink containing portion 43 when the ink tank 21A is in the fourth orientation, the communication port 78 in the first air introduction portion 62*a* is located in a region where the air exists, and the communication port 83 in the second air introduction portion 62*b* is located in a region where the ink IK exists. In the fourth orientation, similar to the first orientation (FIG. 7), leakage of the ink IK in the ink containing portion 43 to the outside is suppressed by the filter member 82 in the second air introduction portion 62*b*. Also, an air distribution passage for the ink containing portion 43 is formed by the first air introduction portion 62*a*. Accordingly, the ink IK in the ink containing portion 43 being pushed out toward the ink supply portion 61 or the second air introduction portion 62*b* by the air in the ink containing portion 43 is suppressed.

Figure 11:
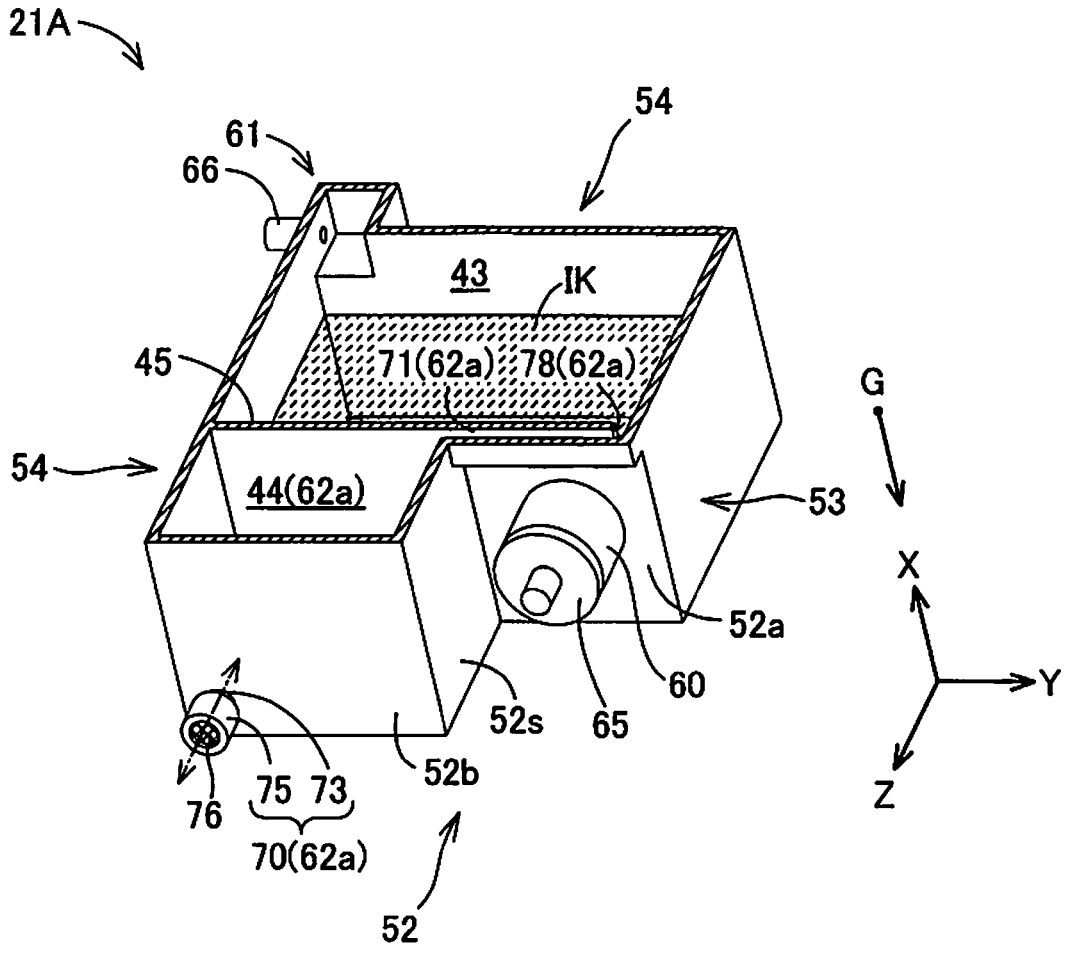
FIG. 11 is a schematic perspective view of the ink tank according to the first embodiment when the ink tank is in a fifth orientation.

FIG. 11 shows the ink tank 21A in a fifth orientation. "Fifth orientation" refers to an orientation obtained by rotating the ink tank 21A from the first orientation to the left side face side by 90 degrees, with the fifth wall portion 55 disposed along a horizontal plane, and with the sixth wall portion 56 located above the fifth wall portion 55. In the ink containing portion 43 when the ink tank 21A is in the fifth orientation, the communication port 78 in the first air introduction portion 62*a* is located in a region where the air exists, and the communication port 83 in the second air introduction portion 62*b* is located in a region where the ink IK exists. In the fifth orientation, similar to the fourth orientation (FIG. 10), leakage of the ink IK in the ink containing portion 43 to the outside is suppressed by the filter member 82 in the second air introduction portion 62*b*. Also, an air distribution passage for the ink containing portion 43 is formed by the first air introduction portion 62*a*. Accordingly, the ink IK in the ink containing portion 43 being pushed out toward the ink supply portion 61 or the second air introduction portion 62*b* by the air in the ink containing portion 43 is suppressed.

Figure 12:
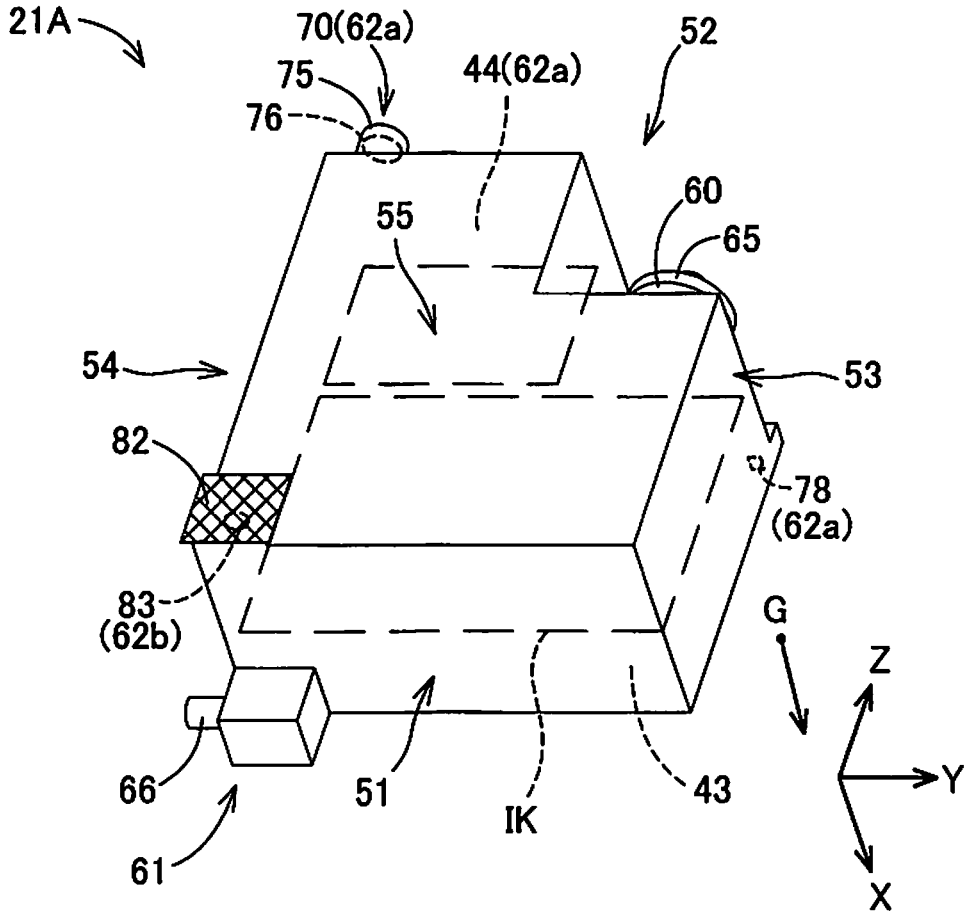
FIG. 12 is a schematic perspective view of the ink tank according to the first embodiment when the ink tank is in a sixth orientation.

FIG. 12 shows the ink tank 21A in a sixth orientation. In FIG. 12, the position of the liquid surface of the ink IK in the ink containing portion 43 and the air chamber 44 is denoted by broken lines. "Sixth orientation" refers to an orientation obtained by rotating the ink tank 21A from the first orientation to the right side face side by 90 degrees, with the sixth wall portion 56 disposed along a horizontal plane, and with the fifth wall portion 55 located above the sixth wall portion 56. In the ink containing portion 43 when the ink tank 21A is in the sixth orientation, the communication port 78 in the first air introduction portion 62*a* is located in a region where the ink IK exists, and the communication port 83 in the second air introduction portion 62*b* is located in a region where the air exists. In the sixth orientation, the ink IK flows into and stored in the air passage portion 71 in the first air introduction portion 62*a* and the air chamber 44. The air intake port portion 70 in the first air introduction portion 62*a* is located in a region on the upper side of the air chamber 44 in the sixth orientation. Accordingly, the ink IK that has flown into the air chamber 44 reaching the air intake port portion 70 is suppressed.

Also, in the sixth orientation, an air distribution passage for the ink containing portion 43 is formed by the second air introduction portion 62*b*. Accordingly, the ink IK in the ink containing portion 43 being pushed out toward the ink injection portion 60 or the ink supply portion 61 due to expansion of the air in the ink containing portion 43 is suppressed. Furthermore, in the sixth orientation, an air distribution passage between the outside and the air chamber 44 is formed by the air intake port portion 70. Accordingly, even in a situation where the air permeability of the filter member 82 in the second air introduction portion 62*b* has degraded, and expanded air in the ink containing portion 43 cannot flow to the outside, the ink IK in the ink containing portion 43 can escape into the air chamber 44. Therefore, an increase in the pressure that the cap member 65 of the ink injection portion 60 and the tube 23 connected to the ink supply portion 61 receive from the ink IK in the ink containing portion 43 due to expansion of the air in the ink containing portion 43 is suppressed.

Here, it is favorable that the filter members 76 and 82 in the air introduction portions 62*a* and 62*b* have air permeability that allows a gas having a pressure smaller than or equal to the limit pressure under which the cap member 65 comes off of the ink injection portion 60 to pass through even in a state where the overall filter members 76 and 82 are wet with the ink. This configuration ensures the air permeability of the filter members 76 and 82 with respect to the air whose pressure is smaller than or equal to the limit pressure for the cap member 65, even immediately after the orientation of the disposed ink tank 21A changes and the filter members 76 and 82 enter a state of being exposed to the air from a state of being exposed to the ink. Accordingly, in such a situation, an increase in the pressure in the ink containing portion 43 to a pressure under which the cap member 65 comes off of the ink injection portion 60 is suppressed, and leakage of the ink from the ink injection portion 60 that has been unexpectedly opened is suppressed.

Summary of First Embodiment

As described above, with the ink tank 21A according to this embodiment, leakage of the ink IK in the ink tank 21A from the air introduction portion 62 is suppressed by the filter members 76 and 82. Even when the ink tank 21A is in any of the above-described first to sixth orientations, an air distribution passage between the ink containing portion 43 and the outside of the ink tank 21A is formed in the ink tank 21A by one of the two air introduction portions 62*a* and 62*b*. Accordingly, even if the printer 10 is carried to a place where the environmental temperature is high or a place where the altitude is high, the air in the ink containing portion 43 expanding and the ink IK being pushed to the outside of the ink tank 21A is suppressed. In addition, with the ink tank 21A according to the first embodiment and the printer 10 that includes the ink tank 21A, various effects described in the first embodiment can be achieved.

B. Second Embodiment

Figure 13:
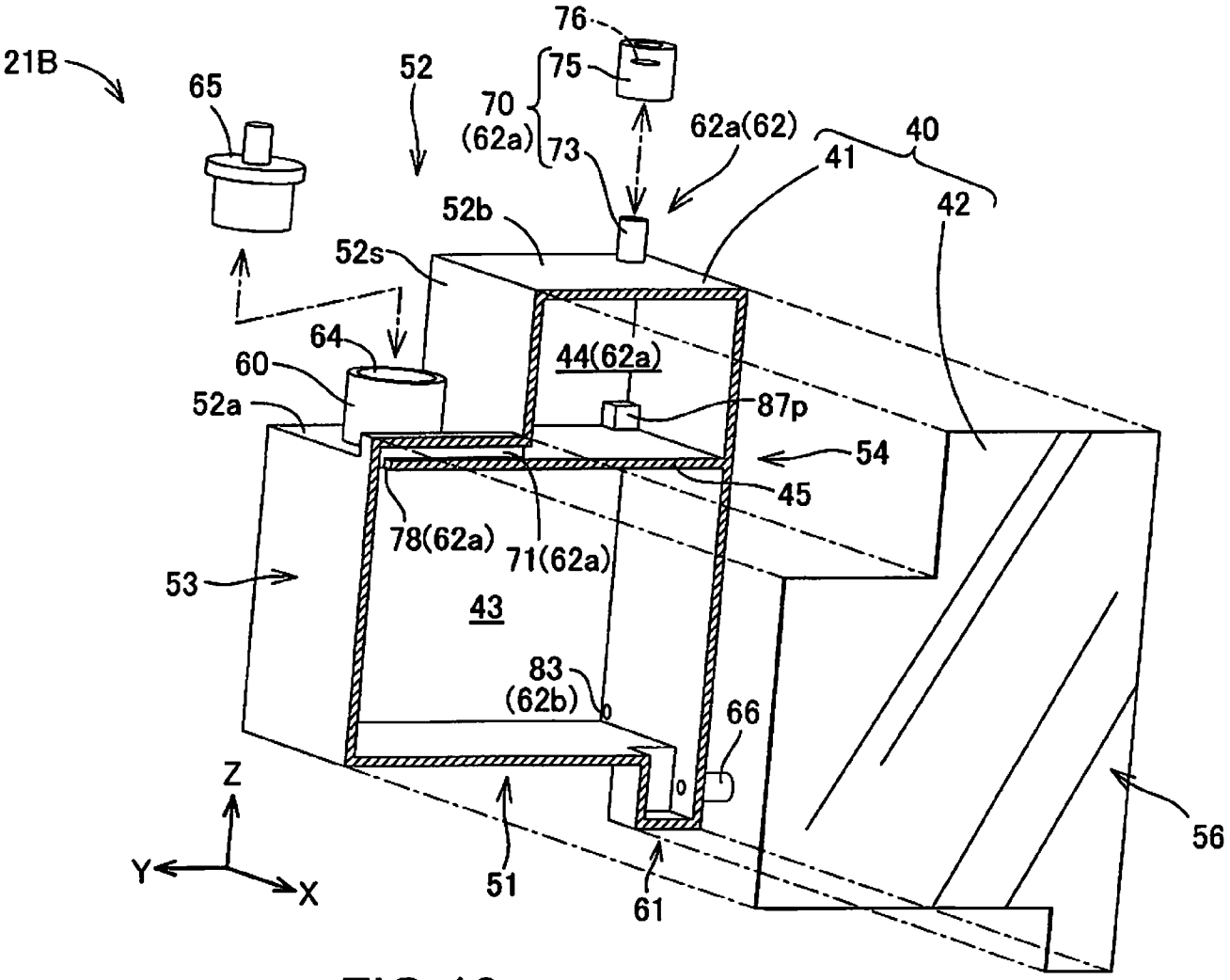
FIG. 13 is a schematic exploded perspective view of an ink tank according to a second embodiment as viewed from a right side face.
Figure 14:
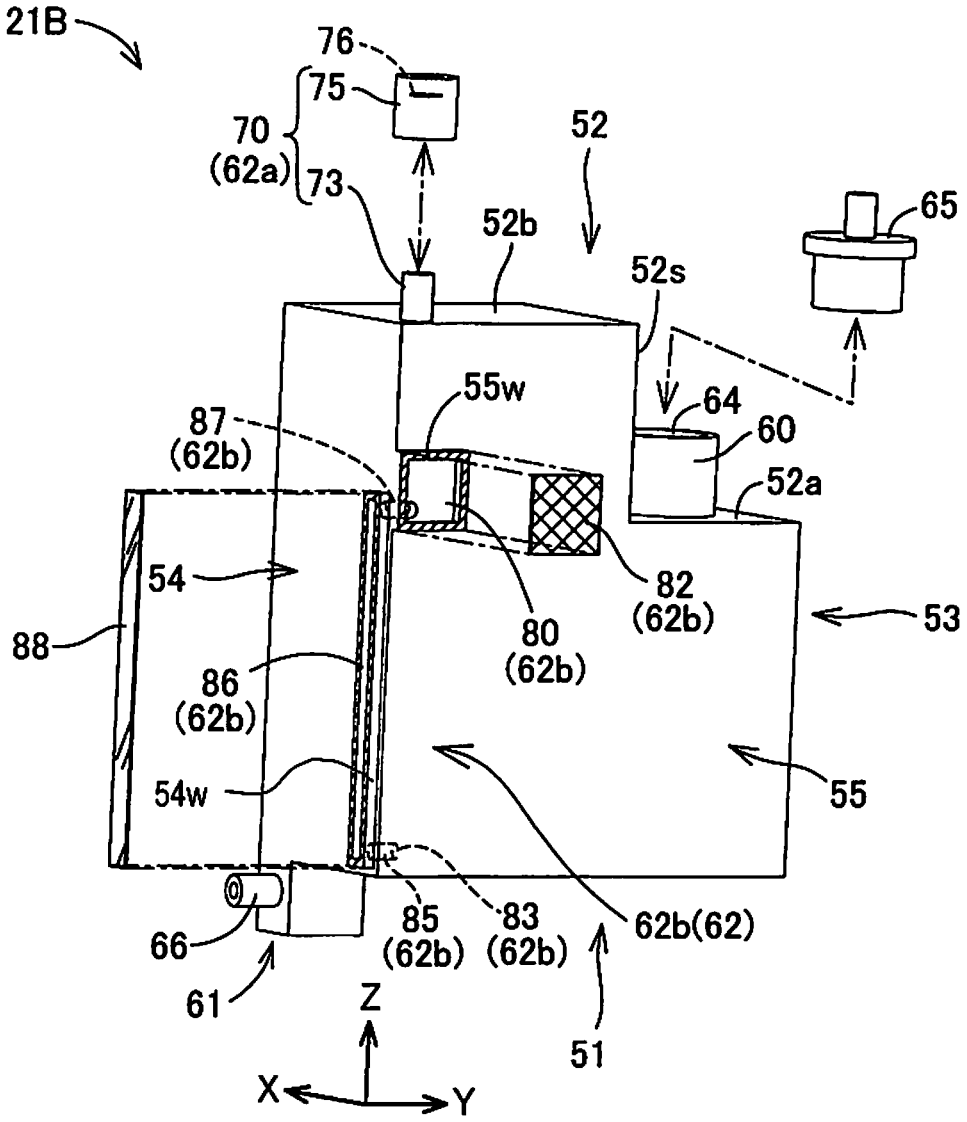
FIG. 14 is a schematic exploded perspective view of the ink tank according to the second embodiment as viewed from a left side face.

A second embodiment of the invention will be described with reference to FIGS. 13 and 14. FIG. 13 is a schematic exploded perspective view of an ink tank 21B according to the second embodiment as viewed from a right side face. FIG. 14 is a schematic exploded perspective view of the ink tank 21B according to the second embodiment as viewed from a left side face. The ink tank 21B according to the second embodiment has roughly the same configuration as the configuration of the ink tank 21A according to the first embodiment, except a configuration of the second air introduction portion 62*b* is different as described below. Note that FIG. 13 omits the two mark portions 58*a* and 58*b* provided on the third wall portion 53 for the sake of convenience. The ink tank 21B according to the second embodiment is installed in a printer having a configuration similar to the configuration of the printer 10 (FIGS. 1 and 2) according to the first embodiment, in an orientation similar to that of the ink tank 21A according to the first embodiment In the ink tank 21B according to the second embodiment, the buffer chamber 80 and the filter member 82 in the second air introduction portion 62*b* are located above the ink containing portion 43 in the first orientation (FIG. 14). The ink containing portion 43 and the buffer chamber 80 are connected by three communicating paths 85 to 87. A first communicating path 85 is formed as a through hole that passes through the fourth wall portion 54 in a corner portion at a lower end of the ink containing portion 43 on the left side face side. In the second embodiment, the communication port 83, which is an entrance and an exit of the second air introduction portion 62*b* in the ink containing portion 43 is open in the fourth wall portion 54 in the arrow Y direction (FIG. 13).

A second communicating path 86 is formed as a groove extending linearly in the arrow Z direction, surrounded by a passage wall portion 54*w*, which is formed as a rib-like projecting portion on an outer surface of the fourth wall portion 54 (FIG. 14). The second communicating path 86 is sealed by a sheet member 88 being adhered to an end face of the passage wall portion 54*w*. The sheet member 88 is made of the same material as the material of the sheet member 42 that constitutes the sixth wall portion 56. A lower end portion of the second communicating path 86 is connected to the first communicating path 85. An upper end portion of the second communicating path 86 is at a height position of a lower end portion of the buffer chamber 80.

A third communicating path 87 is formed by a through hole that connects an upper end portion of the second communicating path 86 to a lower end portion of the buffer chamber 80 on the back side (FIG. 14). The third communicating path 87 extends in the arrow Y direction from the upper end portion of the second communicating path 86, thereafter bends in the direction opposite to the arrow X direction and again extends, and is connected to the buffer chamber 80. A protruding portion 87*p* for forming the third communicating path 87 is provided in a corner portion of the air chamber 44 at a lower end on the fifth wall portion 55 side (FIG. 13).

With the ink tank 21B according to the second embodiment, the second air introduction portion 62*b* can form an air distribution passage for the ink containing portion 43, similarly as described in the first embodiment. Also, when the ink tank 21B is in the first orientation, the buffer chamber 80 is located above the ink containing portion 43. Therefore, the ink that has flown into the second air introduction portion 62*b* reaching the buffer chamber 80 is suppressed. Accordingly, the ink being attached to the filter member 82 in the second air introduction portion 62*b* is suppressed, and the occurrence of clogging in the filter member or degradation of the filter member due to the ink is suppressed. In addition, with the ink tank 21B according to the second embodiment and a printer that includes the ink tank 21B, various effects similar to those described in the first embodiment can be achieved.

C. Third Embodiment

Figure 15:
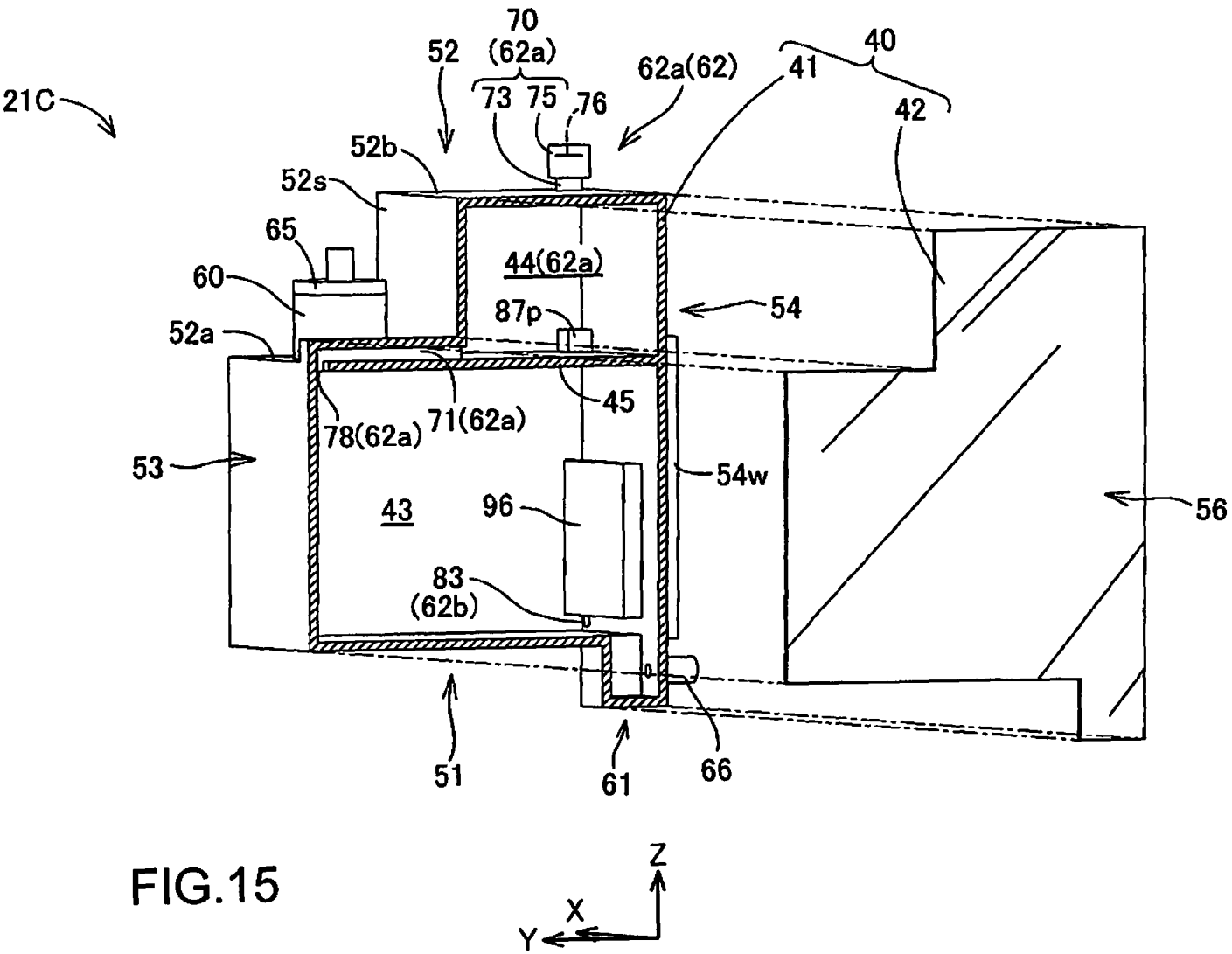
FIG. 15 is a schematic exploded perspective view of an ink tank according to a third embodiment as viewed from a right side face.
Figure 16:
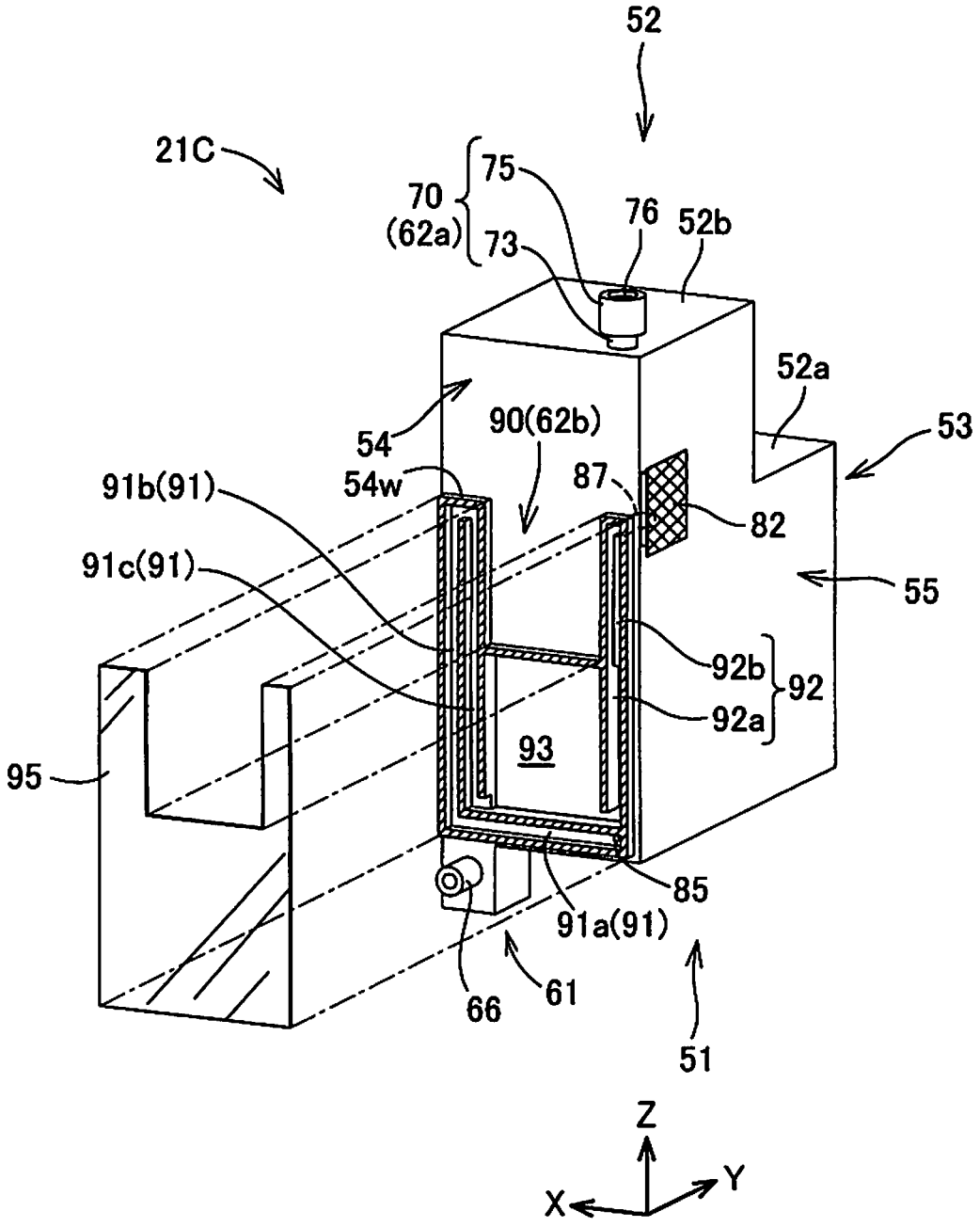
FIG. 16 is a schematic exploded perspective view of an ink tank according to the third embodiment as viewed from a back face.
Figure 17:
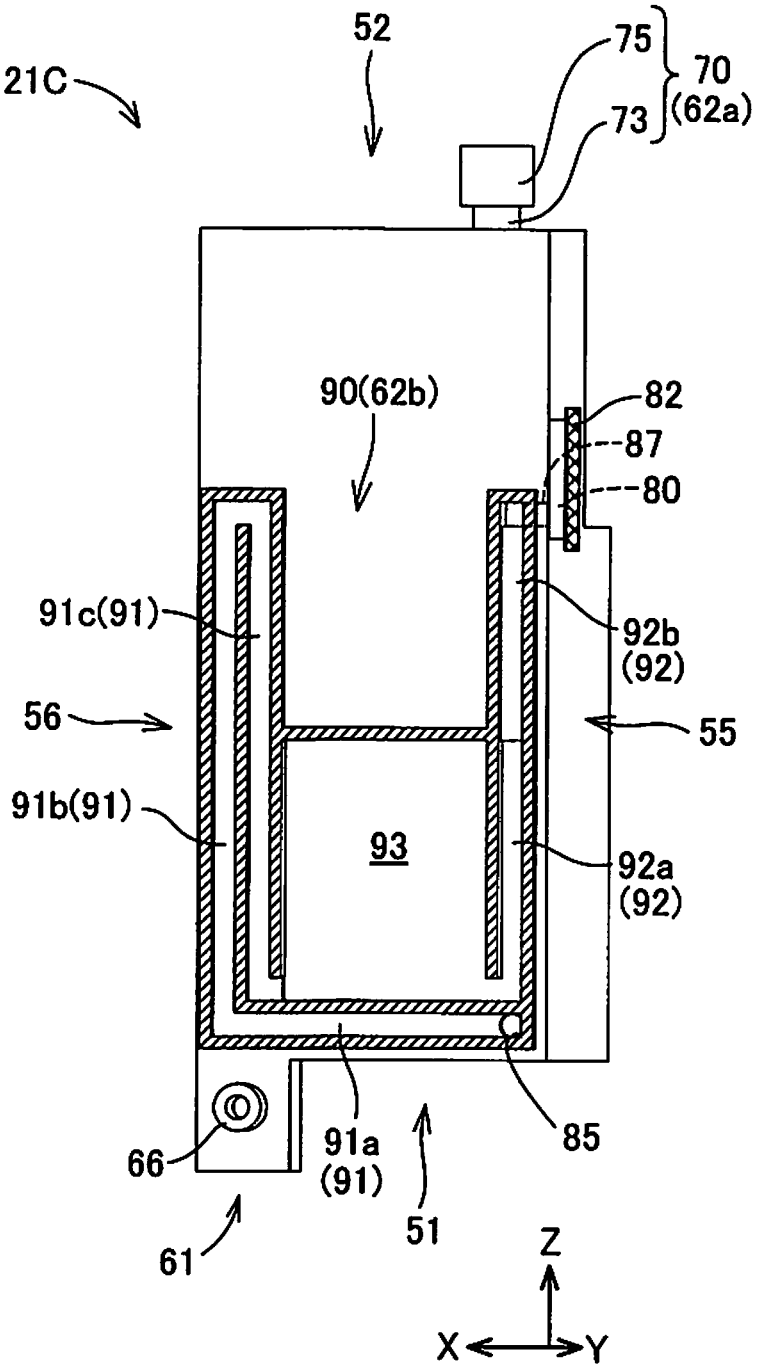
FIG. 17 is a schematic view showing a configuration of a back face flow path portion provided in a second air introduction portion according to the third embodiment.

A configuration of an ink tank 21C according to a third embodiment of the invention will be described with reference to FIGS. 15 to 17. FIG. 15 is a schematic exploded perspective view of the ink tank 21C according to the third embodiment as viewed from a right side face. FIG. 15 omits the two mark portions 58*a* and 58*b* provided on the third wall portion 53 for the sake of convenience. FIG. 16 is a schematic exploded perspective view of the ink tank 21C according to the third embodiment as viewed from a back face. FIG. 17 is a schematic view showing a configuration of a back face flow path portion 90 provided in the second air introduction portion 62*b* in the ink tank 21C according to the third embodiment. The ink tank 21C according to the third embodiment has roughly the same configuration as that of the ink tank 21B according to the second embodiment, except that the second air introduction portion 62*b* has the back face flow path portion 90 in place of the second communicating path 86. The ink tank 21C according to the third embodiment is installed in a printer having a configuration similar to that of the printer 10 (FIGS. 1 and 2) according to the first embodiment, in an orientation similar to that of the ink tank 21A according to the first embodiment.

In the second air introduction portion 62*b* according to the third embodiment, the ink containing portion 43 and the buffer chamber 80 are connected by the back face flow path portion 90 provided on the back face of the ink tank 21C (FIG. 16). The back face flow path portion 90 has a first back face flow path 91, a second back face flow path 92, and an intermediate buffer chamber 93. Hereinafter, the buffer chamber 80 will also be called a "terminal buffer chamber 80" in order to distinguish between the buffer chamber 80 and the intermediate buffer chamber 93.

The first back face flow path 91 is a flow path on the ink containing portion 43 side, and the second back face flow path 92 is a flow path on the terminal buffer chamber 80 side. The intermediate buffer chamber 93 is a space that connects the first back face flow path 91 and the second back face flow path 92 and has a larger volume than the volume of the first back face flow path 91 and the second back face flow path 92. The first back face flow path 91, the second back face flow path 92, and the intermediate buffer chamber 93 are formed as a recessed portion surrounded by the passage wall portion 54*w*. The passage wall portion 54*w* is a rib-like projecting portion formed on an outer wall face of the fourth wall portion 54. The overall back face flow path portion 90 is sealed by a sheet member 95 being adhered to an end face of the passage wall portion 54*w*. The sheet member 95 is made of the same material as that of the sheet member 42 that constitutes the sixth wall portion 56.

The first back face flow path 91 is constituted by three flow path parts 91*a* to 91*c* (FIG. 17). A first flow path part 91*a* extends at a lower end of the fourth wall portion 54 in the arrow Y direction from an end portion on the fifth wall portion 55 side to an end portion on the sixth wall portion 56 side. The first flow path part 91*a* is connected, in an end portion on the fifth wall portion 55 side, to the first communicating path 85 that is in communication with the ink containing portion 43, and is connected, in an end portion on the sixth wall portion 56 side, to a second flow path part 91*b*. The second flow path part 91*b* extends in the arrow Z direction in an end portion of the fourth wall portion 54 on the sixth wall portion 56 side, up to roughly the same height position as that of the lower end of the terminal buffer chamber 80 of the fifth wall portion 55. The second flow path part 91*b* folds back at the upper end thereof in the direction opposite to the arrow X direction, and is then connected to a third flow path part 91*c*. The third flow path part 91*c* is adjacent to the second flow path part 91*b* in parallel, and extends up to before the first flow path part 91*a*. The third flow path part 91*c* is in communication with the intermediate buffer chamber 93 at the lower end.

The second back face flow path 92 extends in the arrow Z direction in an end portion of the fourth wall portion 54 on the fifth wall portion 55 side, up to roughly the same height position as that of the lower end of the terminal buffer chamber 80 on the fifth wall portion 55 (FIG. 17). The second back face flow path 92 is connected, at the upper end thereof, to the third communicating path 87 that is in communication with the terminal buffer chamber 80. Also, the second back face flow path 92 is connected, at the lower end thereof, to the lower end of the intermediate buffer chamber 93.

The depth in the arrow Y direction of a first flow path part 92*a* of the second back face flow path 92 that is adjacent to the intermediate buffer chamber 93 is the same as that of the intermediate buffer chamber 93 (FIGS. 16 and 17). Also, the depth in the arrow Y direction of the second flow path part 92*b* between the first flow path part 92*a* and the third communicating path 87 is roughly the same as the depth in the arrow Y direction of the first back face flow path 91, i.e. the height of the passage wall portion 54*w*.

The intermediate buffer chamber 93 is formed as an internal space having a tabular, substantially rectangular parallelepiped shape at a position adjacent to the third flow path part 91*c* of the first back face flow path 91 and the second back face flow path 92 (FIG. 17). The upper end of the intermediate buffer chamber 93 in the arrow Z direction is located at a height that is roughly half the height of the upper ends of the first back face flow path 91 and the second back face flow path 92.

The intermediate buffer chamber 93 is formed such that the depth thereof in the arrow Y direction is greater than that of first back face flow path 91 and the second back face flow path 92 in order to ensure a larger space volume than the volume of the first back face flow path 91. Also, as mentioned above, the first flow path part 92*a* of the second back face flow path 92, which is at a position adjacent to the intermediate buffer chamber 93, has roughly the same depth as that of the intermediate buffer chamber 93. In the ink containing portion 43, a protruding portion 96, which houses the intermediate buffer chamber 93 and the first flow path part 92*a* of the second back face flow path 92, is formed at a position on the side opposite to the intermediate buffer chamber 93 and the first flow path part 92*a* of the second back face flow path 92 (FIG. 15).

When the ink tank 21C is in the first orientation with the ink and the air existing in the ink containing portion 43, the ink in the ink containing portion 43 flows into the first flow path part 91*a* of the first back face flow path 91. The second flow path part 91*b* extends up to a higher position than the upper end of the ink containing portion 43. Therefore, the ink that has flown into the first flow path part 91*a* flowing over the second flow path part 91*b* and reaching the third flow path part 91*c* and the intermediate buffer chamber 93 is suppressed.

Also, when the ink tank 21C is in the first orientation, an air distribution passage for the ink containing portion 43 is formed by the first air introduction portion 62*a* (FIG. 15). Therefore, even in an environment where the air in the ink containing portion 43 expands, the air in the ink containing portion 43 can escape into the first air introduction portion 62*a*, and the ink in the ink containing portion 43 being pushed out to the second air introduction portion 62*b* is suppressed. Accordingly, the ink that has flown in up to the second flow path part 91*b* of the first back face flow path 91 being further pushed out up to the third flow path part 91*c* is also suppressed. Furthermore, the second air introduction portion 62*b* according to the third embodiment is provided with a space in which the ink that has flown in can be stored, as described below. Therefore, the ink reaching the filter member 82 in the terminal buffer chamber 80 is suppressed.

Figure 18:
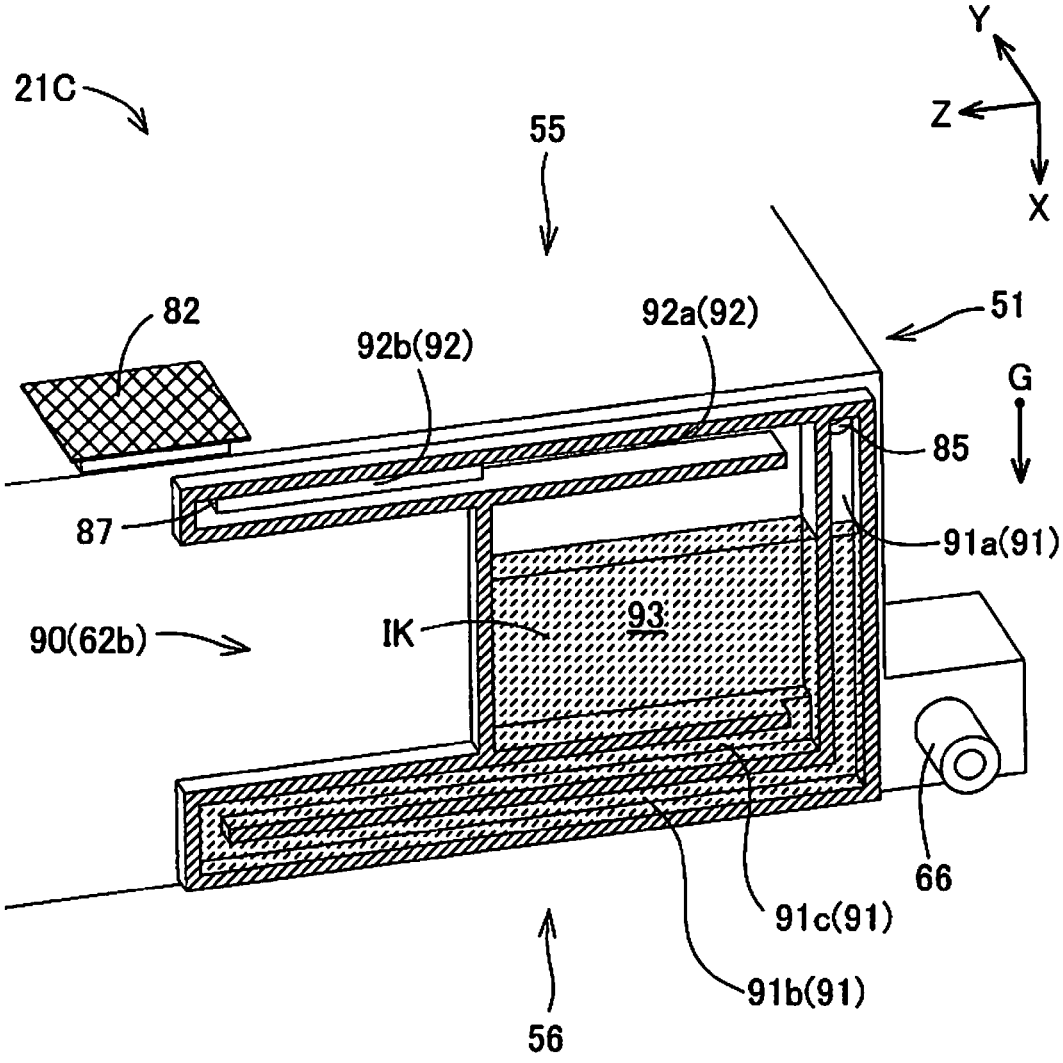
FIG. 18 is a schematic view of the back face flow path portion when the ink tank according to the third embodiment is in the sixth orientation.
Figure 19:
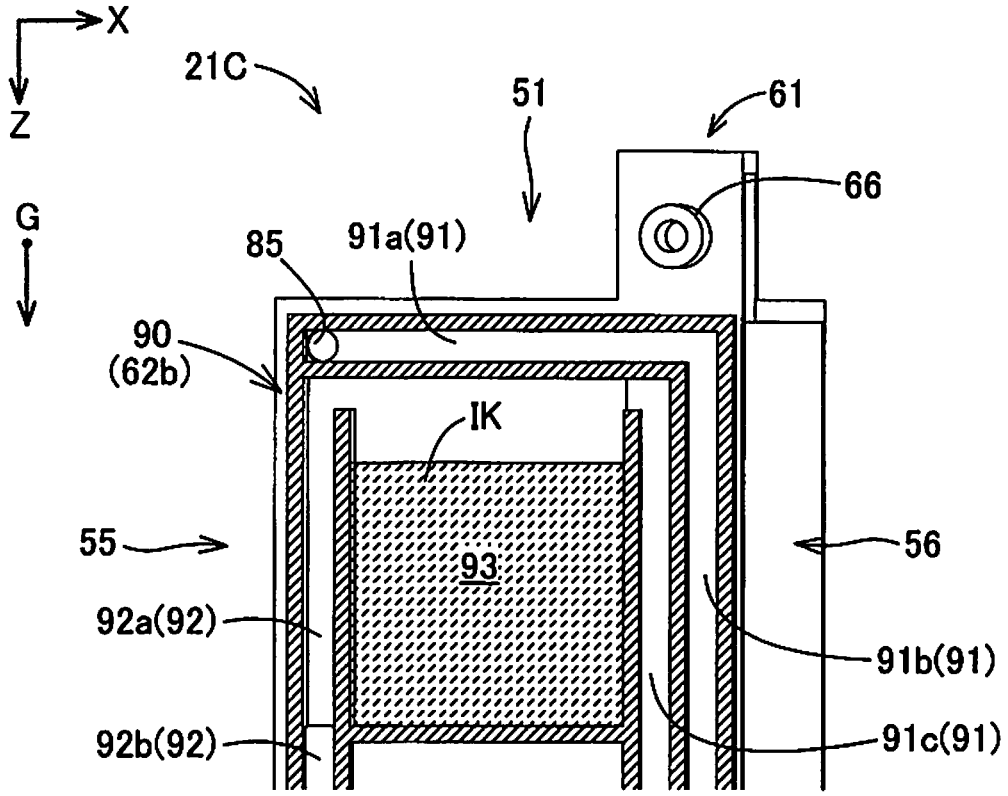
FIG. 19 is a schematic view of the back face flow path portion when the ink tank according to the third embodiment is in the second orientation.
Figure 20:
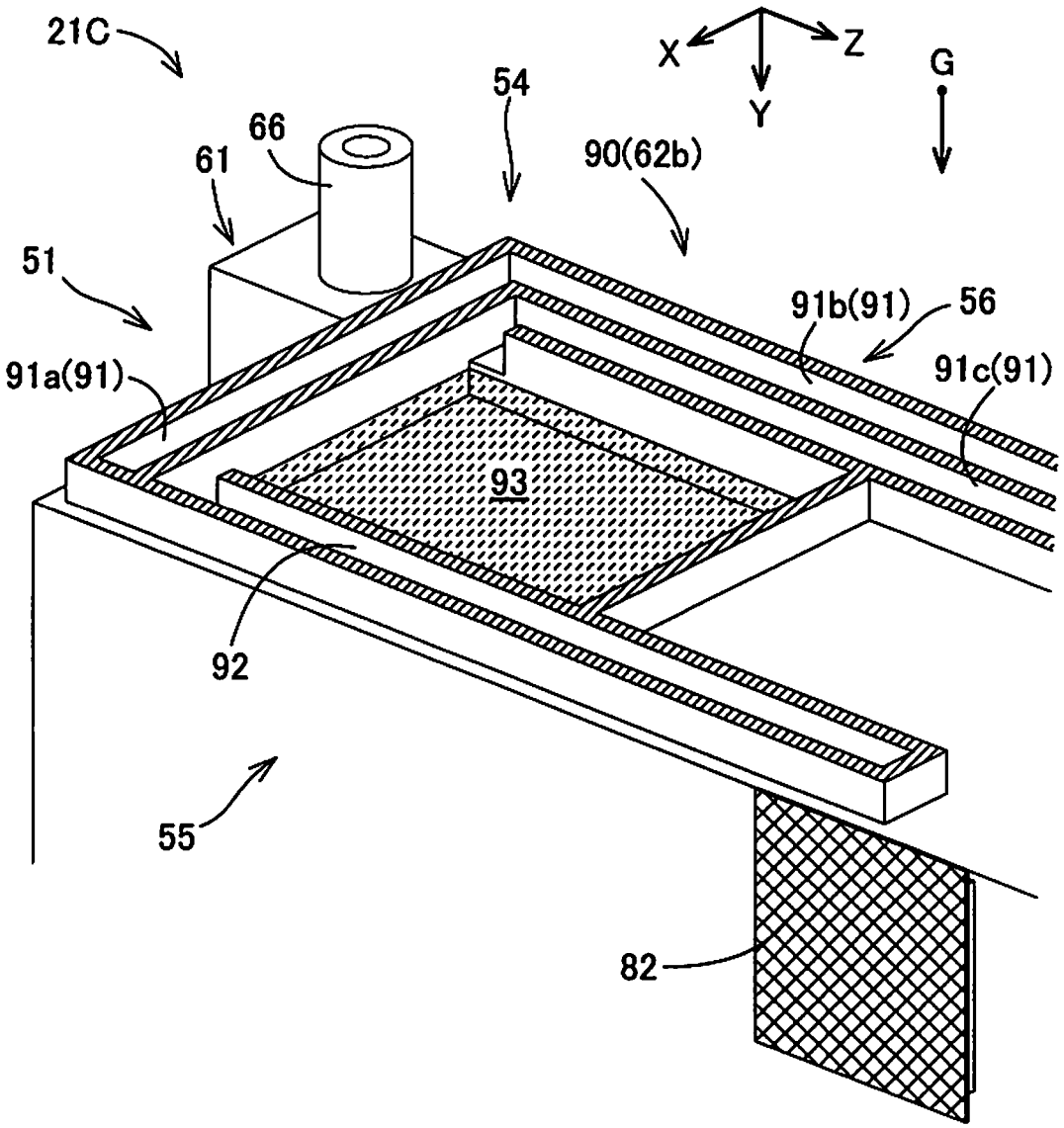
FIG. 20 is a schematic view of the back face flow path portion when the ink tank according to the third embodiment is in the third orientation.

A configuration in which ink is stored in the second air introduction portion 62*b* according to the third embodiment will be described with reference to FIGS. 18 to 20. FIG. 18 is a schematic view showing an exemplary state of the back face flow path portion 90 when the ink tank 21C is in the sixth orientation. FIG. 19 is a schematic view showing an exemplary state of the back face flow path portion 90 when the ink tank 21C is in the second orientation. FIG. 20 is a schematic view showing an exemplary state of the back face flow path portion 90 when the ink tank 21C is in the third orientation.

The intermediate buffer chamber 93 is configured to be able to store the ink IK at least in orientations in which the communication port 83 in the second air introduction portion 62*b* is located in a region where the air exists, such as the sixth orientation (FIG. 18), the second orientation (FIG. 19), and the third orientation (FIG. 20). Therefore, in such an orientation, the ink IK reaching the filter member 82 is suppressed, and the lowering or degradation of the air permeability of the filter member 82 due to ink components being attached thereto is suppressed. Furthermore, the ink tank 21C according to the third embodiment can achieve the following effects.

If the orientation of the ink tank 21C when disposed is rotated from the first orientation, the ink IK that has flown into the first back face flow path 91 in the second air introduction portion 62*b* when the ink tank 21C was in the first orientation reaches the intermediate buffer chamber 93 in some cases. Even in such cases, with the ink tank 21C according to the third embodiment, the intermediate buffer chamber 93 has a larger volume than that of the first back face flow path 91. Therefore, the ink IK that has flown into the first back face flow path 91 can be stored in the intermediate buffer chamber 93 after the orientation has changed. Accordingly, the ink IK reaching the filter member 82 is further suppressed.

Also, in the second and third orientations, the second air introduction portion 62*b* being blocked by the ink IK is suppressed by the ink IK being stored in the intermediate buffer chamber 93, as shown in FIGS. 19 and 20. Accordingly, the air distribution passage for the ink containing portion 43 being blocked is suppressed.

In addition, in the second back face flow path 92, the depth in the arrow Y direction is different between the first flow path part 92*a* and the second flow path part 92*b*. Accordingly, a step is formed between the first flow path part 92*a* and the second flow path part 92*b*. Therefore, when the ink tank 21C is in the third orientation (FIG. 20), the ink IK in the back face flow path portion 90 reaching the second flow path part 92*b* of the second back face flow path 92 is suppressed by the step between the first flow path part 92*a* and the second flow path part 92*b*.

As described above, in the ink tank 21C according to the third embodiment, the ink reaching the filter member 82 is suppressed as a result of the back face flow path portion 90 being provided in the second air introduction portion 62*b*. Furthermore, in orientations in which the communication port 83 is located in a region of the ink containing portion 43 where the air exists, such as the second orientation and the third orientation, the flow path in the second air introduction portion 62*b* being blocked by the ink is suppressed. In addition, with the ink tank 21C according to the third embodiment and a printer that includes the ink tank 21C, various effects described in the first and second embodiments can be achieved.

D. Fourth Embodiment

Figure 21:
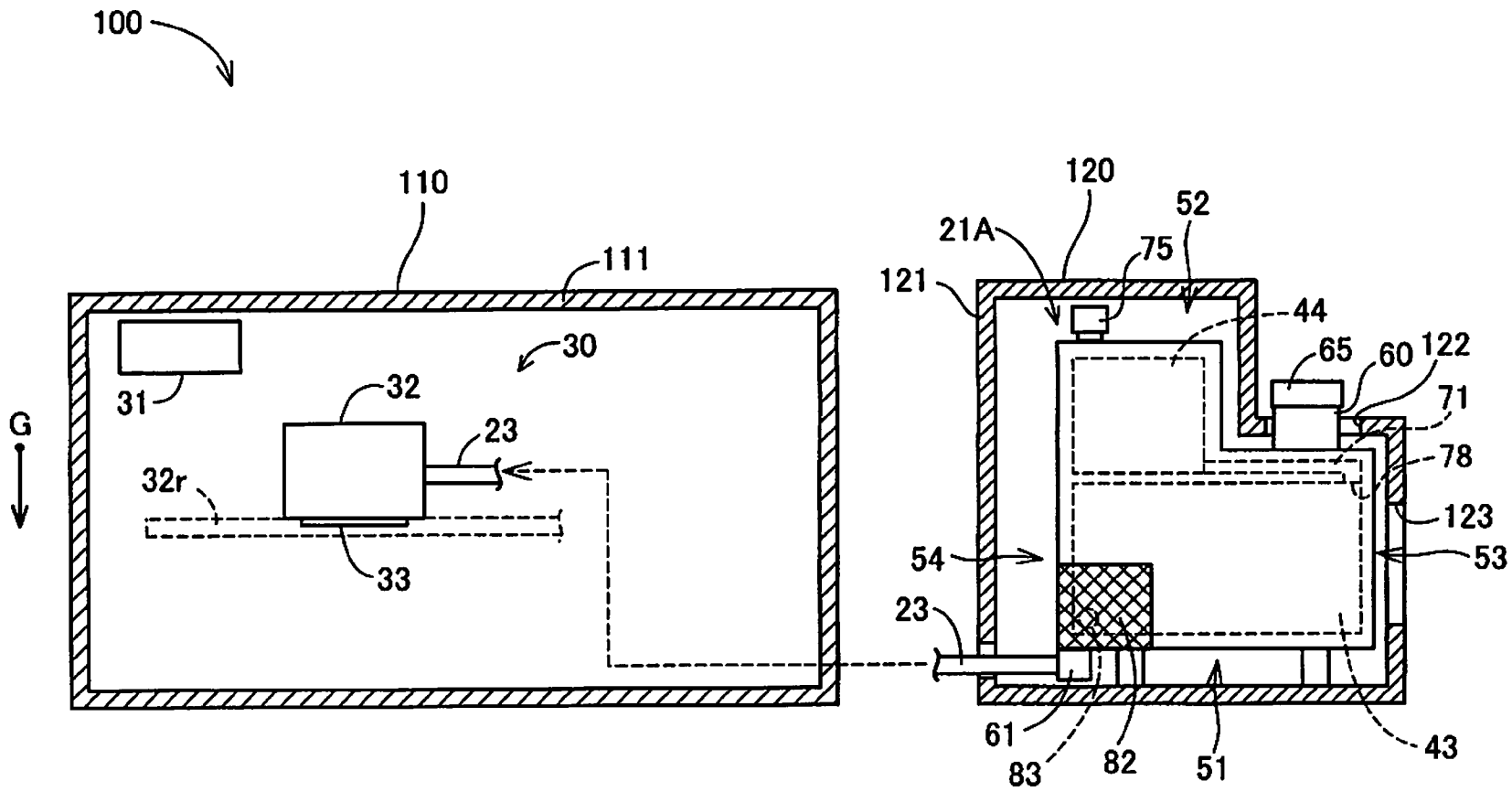
FIG. 21 is a schematic view showing a configuration of a printing system according to a fourth embodiment.

FIG. 21 is a schematic view showing a configuration of a printing system 100 according to a fourth embodiment. The printing system 100 is an embodiment of a liquid ejection system, and includes a main body portion 110 and a tank unit 120. The main body portion 110 includes a printing portion 30 and a casing portion 111. The printing portion 30 has a configuration that is roughly similar to the configuration of the printing portion 30 included in the printer 10 according to the first embodiment. The casing portion 111 is a resin hollow box for housing the printing portion 30, and has a configuration that is roughly similar to the configuration of the casing portion 11 included in the printer 10 according to the first embodiment, except that the part in which the ink tank 21A is housed is omitted. Note that FIG. 21 omits the two mark portions 58*a* and 58*b* provided on the third wall portion 53 for the sake of convenience.

In the tank unit 120, a plurality of ink tanks 21A having a configuration similar to the configuration described in the first embodiment are housed in a casing portion 121, which is a resin hollow box. In the casing portion 121, the ink tanks 21A are fixed in the first orientation and arranged in a line such that the third wall portions 53 thereof are linearly aligned. The tubes 23, which are similar to that described in the first embodiment, is connected to the ink supply portions 61 (FIG. 3) of the respective ink tanks 21A in one-to-one correspondence. Each tube 23 extends from the casing portion 121, and is drawn into the casing portion 111 of the main body portion 110 and connected to the carriage 32 in the printing portion 30 such that ink can be supplied to the print head 33 in the main body portion 110.

The casing portion 121 has a plurality of through holes 122 and a window portion 123. The plurality of through holes 122 are provided in correspondence with the respective ink tanks 21A. The ink injection portion 60 of the corresponding ink tank 21A projects to the outside from each through hole 122. This configuration allows the user to supply ink to the ink tanks 21A in a state of being housed in the casing portions 121, from the outside via the ink injection portions 60.

The window portion 123 is formed at a position directly facing the third wall portions 53 of the ink tanks 21A. The user can visually check the position of the liquid surface of the ink that can be seen through the third wall portions 53 of the ink tanks 21A via the window portion 123. In a state where each ink tank 21A is fixed in the casing portion 111, the communication port 78 in the first air introduction portion 62*a* in the ink tank 21A is located at a higher position than the window portion 123, and is out of the visual field of the user who is directly facing the window portion 123. For this reason, when the user supplies ink to the ink tank 21A, the ink being excessively supplied to the extent that the liquid surface of the ink reaches the communication port 78 is suppressed.

With the printing system 100 according to the fourth embodiment, the main body portion 110 in which print processing is executed and the tank unit 120 that serves as an ink supply source are configured to be separate bodies. Accordingly, the degree of freedom in the manner of disposing the printing system 100 increases. Also, maintenance of the tank unit 120 according to the fourth embodiment can be performed independently from the main body portion 110. Accordingly, the maintainability has improved. In addition, with the tank unit 120 according to the fourth embodiment and a printing system 100 that includes the tank unit 120, various effects similar to those described in the first embodiment can be achieved.

E. Modifications

The configurations according to the above embodiments can be modified or changed in various manners as in exemplary modifications described below. Note that, in the following description, the ink tanks 21A to 21C in the embodiments are collectively referred to as an "ink tank 21" when particular distinction is not required.

E1. Modification 1:

In the above embodiment, in the first orientation, the communication port 78 in the first air introduction portion 62*a* is located in the upper surface of the ink containing portion 43, and the communication port 83 in the second air introduction portion 62*b* is located at the lower end of the ink containing portion 43. In contrast, the communication port 78 in the first air introduction portion 62*a* and the communication port 83 in the second air introduction portion 62*b* may be provided at other positions. In a state where the air and ink that occupies half the ink capacity of the ink containing portion 43 are contained in the ink containing portion 43, the communication port 78 in the first air introduction portion 62*a* need only be (i) located in a region where the air exists when the ink tank 21 is in the first orientation, and (ii) located in a region where the ink exists when the ink tank 21 is in the second orientation. Also, in a state where the air and ink that occupies half the ink capacity of the ink containing portion 43 are contained in the ink containing portion 43, the communication port 83 in the second air introduction portion 62*b* need only be (i) located in a region where the ink exists when the ink tank 21 is in the first orientation, and (ii) located in a region where the air exists when the ink tank 21 is in the second orientation. Accordingly, the communication port 78 in the first air introduction portion 62*a* may be provided at a lower position than an upper end portion of the third wall portion 53, or may be provided at an intermediate position of the ink containing portion 43 in the arrow Y direction, for example. The communication port 83 in the second air introduction portion 62*b* may not be formed at the lower end of the ink containing portion 43, and may be formed at an intermediate position between the intermediate position of the ink containing portion 43 and the lower end thereof in the arrow Z direction, for example. The communication port 83 in the second air introduction portion 62*b* may be provided at an intermediate position of the ink containing portion 43 in the arrow X direction. Furthermore, the opening directions of the communication port 78 in the first air introduction portion 62*a* and the communication port 83 in the second air introduction portion 62*b* may be formed so as to face in directions other than the directions described in the above embodiments. For example, the communication port 78 in the first air introduction portion 62*a* may be provided so as to be open in the direction opposite to the arrow Y direction or in the direction opposite to the arrow X direction. The communication port 83 in the second air introduction portion 62*b* may be provided so as to be open in the direction opposite to the arrow Z direction or the direction opposite to the arrow Y direction. Note that the aforementioned amount of the ink that occupies half the ink capacity of the ink containing portion 43 may include a fluctuation range of an error range of about ±10%.

E2. Modification 2:

In the ink tank 21 according to the above embodiments, the first air introduction portion 62*a* has the air chamber 44, and the second air introduction portion 62*b* has the buffer chamber 80. In contrast, the air chamber 44 and/or the buffer chamber 80 may be omitted. For example, the ink tank 21 may have a configuration in which the inner wall portion 45 is omitted, and the ink containing portion 43 and the air chamber 44 are integrated. In the case of this configuration, the opening of the tubing portion 73 of the air intake port portion 70 on the lower end side corresponds to a specific concept of the second air introduction port according to the invention.

E3. Modification 3:

The ink tank 21 according to the above embodiments is formed as a hollow container having six wall portions 51 to 56. In contrast, the ink tank 21 may not have all of the six wall portions 51 to 56. For example, the exterior shape of the ink tank 21 may be changed into various shapes as appropriate, such as a substantially triangular prism shape, a substantially square prism shape, a substantially pentagonal prism shape, a substantially cylindrical shape, or a substantially oval cylindrical shape. Also, in the above embodiments, the ink tank 21 has a configuration in which the sheet member 42 is adhered to the case member 41. In contrast, the ink tank 21 may be configured to be a hollow container that is entirely formed in an integrated manner by means of integral molding, or may have a configuration in which the ink containing portion 43, the air chamber 44, and the buffer chamber 80, which are formed as separate bodies, are connected to one another by tubes or the like, for example.

E4. Modification 4:

In the ink tank 21 according to the above embodiments, the filter member 76 is detachably attached together with the ventilation cap member 75 to the first air introduction portion 62*a*. In contrast, the filter member 76 in the first air introduction portion 62*a* may not be directly joined to the tubing portion 73. Also, in the ink tank 21 according to the above embodiments, the filter member 82 in the second air introduction portion 62*b* is joined to the wall portion 55*w* that surrounds the buffer chamber 80. In contrast, the filter member 82 in the second air introduction portion 62*b* may be detachably attached to the ink tank 21, as the filter member 76 in the first air introduction portion 62*a* is.

E5. Modification 5:

In the above embodiments, the first orientation of the ink tank 21 is an orientation when ink is injected by the user, and is also an orientation when the ink is supplied to the print head 33 at the time of discharging ink droplets. In contrast, the first orientation of the ink tank 21 may be different from the orientation when the ink is supplied to the print head 33 at the time of discharging ink droplets. Alternatively, the first orientation of the ink tank 21 may be different from the orientation when the user injects the ink.

E6. Modification 6:

In the ink tank 21 according to the above embodiments, the third wall portion 53 is configured to be translucent, thereby functioning as a visual check portion for enabling the position of the liquid surface of the ink in the ink containing portion 43 to be visually checked from the outside. In contrast, in the ink tank 21, wall portions other than the third wall portion 53 may function as the visual check portion. Also, the ink tank 21 may have the visual check portion that enables the position of the liquid surface of the ink indicating the amount of the ink contained in the ink containing portion 43 to be visually checked, in a cylindrical container that is in communication with the ink containing portion 43 through a tube. Alternatively, the ink tank 21 may not have such a visual check portion.

E7. Modification 7:

In the fourth embodiment, the tank unit 120 has the ink tank 21A described in the first embodiment. In contrast, the tank unit 120 may include an ink tank having a configuration that is different from the ink tank 21A. The tank unit 120 may include the ink tank 21B according to the second embodiment or the ink tank 21C according to the third embodiment, for example. In such cases, the tank unit 120 and the printing system 100 can achieve various effects similar to those described in the second embodiment and the third embodiment.

E8. Modification 8:

In the above embodiments, the printer 10 or the printing system 100 has four ink tanks 21. In contrast, the printer 10 or the printing system 100 may include only one ink tank 21, or may include two or three ink tanks 21. The printer 10 or the printing system 100 may include five or more ink tanks 21. In the above embodiments, the plurality of ink tanks 21 are configured to be separate bodies. In contrast, the ink tanks 21 may be connected integrally by sharing the fifth wall portion 55 and the sixth wall portion 56, for example.

E9. Modification 9:

The above embodiments have described configurations of the ink tank 21 that is configured such that ink can be supplied to the print head 33 provided in the printer 10 or the printing system 100. In contrast, the configurations of the ink tank 21 according to the above embodiments may be applied to a tank for containing liquid supplied to a liquid ejection head provided in a liquid ejection apparatus or a liquid ejection system other than the printer or the printing system. For example, the configurations of the ink tank 21 may be applied to a detergent tank for supplying a liquid detergent to a liquid ejection head of a detergent ejection apparatus for ejecting the detergent. The configurations of the ink tank 21 according to the embodiments may also be applied to a tank for supplying liquid to a liquid consuming system that consumes the liquid using a method other than ejection.

The invention is not limited to the above embodiments, examples, and modifications, and can be achieved with various configurations without departing from the gist of the invention. For example, the technical features in the embodiments, the examples, and the modifications that correspond to the technical features in the modes described in the summary of the invention may be replaced or combined as appropriate in order to solve a part of or the entire foregoing problem, or to achieve some or all of the above-described effects. The technical features that are not described as essential in the specification may be deleted as appropriate.

What is claimed is:

1. A tank with which liquid is configured to be supplied to a liquid ejection head, comprising:

a liquid containing portion configured to contain the liquid;

an air introduction portion, through which outside air is introduced into the liquid containing portion;

a liquid injection portion, through which the liquid is injected into the liquid containing portion from outside; and a sealing member that is detachably attached to the liquid injection portion, wherein the air introduction portion includes a first air introduction portion that is in communication with the liquid containing portion, and a second air introduction portion, the first air introduction portion includes a first air introduction port that is open in the liquid containing portion, and a first air flow path that is a flow path for the air from the outside to the first air introduction port, the second air introduction portion includes a second air introduction port that is open in the liquid containing portion, and a second air flow path that is a flow path for the air from the outside to the second air introduction port, in a state where the air and the liquid that occupies half a liquid capacity of the liquid containing portion are contained in the liquid containing portion, (i) when the tank is in a first orientation, which is an orientation when the liquid is injected from the liquid injection portion, the first air introduction port is located in a region where the air exists, and the second air introduction port is located in a region where the liquid exists, and (ii) when the tank is in a second orientation, in which the tank is rotated by 180 degrees relative to the first orientation such that upper and lower sides thereof are inverted, the first air introduction port is located in a region where the liquid exists, and the second air introduction port is located in a region where the air exists, in the first air flow path, a first member that is configured to pass the air through the inside and is configured to block the liquid through the inside, the first member is disposed so as to block the first air flow path, and in the second air flow path, a second member that is configured to pass the air through the inside and is configured to block the liquid through the inside, the second member is disposed so as to block the second air flow path.

2. The tank according to claim 1, wherein the first air flow path includes a first liquid containing chamber in which the liquid that flow into the first air flow path configured to be stored in an orientation obtained by rotating the tank from the first orientation.

3. The tank according to claim 1, wherein the second air flow path includes a second liquid containing chamber in which the liquid that flow into the second air flow path configured to be stored, between the second air introduction port and the second member.

4. The tank according to claim 3, wherein a volume of the second liquid containing chamber is greater than or equal to a volume of a flow path space between the second air introduction port and the second liquid containing chamber.

5. The tank according to claim 1, wherein at least one of the first member and the second member is joined to the tank on the outside of the tank.

6. The tank according to claim 1, wherein at least one of the first member and the second member is detachably attached to the tank on the outside of the tank.

7. The tank according to claim 1, further comprising:

a first wall portion disposed along a horizontal plane perpendicular to a gravity direction in the first orientation;

a second wall portion opposing the first wall portion, the second wall portion being located above the first wall portion in the first orientation;

a third wall portion intersecting the first wall portion and the second wall portion;

a fourth wall portion intersecting the first wall portion and the second wall portion, and opposing the third wall portion;

a fifth wall portion intersecting the first wall portion, the second wall portion, the third wall portion, and the fourth wall portion; and a sixth wall portion intersecting the first wall portion, the second wall portion, the third wall portion, and the fourth wall portion, and opposing the fifth wall portion, wherein, in a state where at least the air and the liquid that occupies half a liquid capacity of the liquid containing portion are contained in the liquid containing portion, the air exists in at least one of the first air flow path and the second air flow path when the tank is placed in any one of the first orientation, the second orientation, a third orientation in which the third wall portion is disposed along the horizontal plane and the fourth wall portion is located above the third wall portion, a fourth orientation in which the fourth wall portion is disposed along the horizontal plane and the third wall portion is located above the fourth wall portion, a fifth orientation in which the fifth wall portion is disposed along the horizontal plane and the sixth wall portion is located above the fifth wall portion, and a sixth orientation in which the sixth wall portion is disposed along the horizontal plane and the fifth wall portion is located above the sixth wall portion.

8. The tank according to claim 1, wherein, when the tank is in the first orientation in a state where the air and the liquid that occupies half a liquid capacity of the liquid containing portion are contained in the liquid containing portion, at least one of the first member and the second member is located above a liquid surface in the liquid containing portion.

9. The tank according to claim 1, wherein, at least in a state where the overall first member and second member are wet with the liquid, the first member and the second member can let the air pass through under a pressure lower than or equal to a limit pressure from the inside of the liquid containing portion under which the sealing member coming off of the liquid injection portion is suppressed.

10. A tank unit comprising:

the tank according to claim 1; and an exterior portion that houses the tank, wherein the tank includes a visual check portion that is configured to visually check a position of a surface of the liquid contained in the liquid containing portion, the exterior portion includes a window portion that enables the visual check portion of the tank to be visually checked from the outside, and when the tank is in the first orientation, the first air introduction port is located at a higher position than an upper end of the window portion.

11. A liquid ejection system comprising:

the tank unit according to claim 10; and a liquid ejection apparatus to which the tank unit is connected, the liquid ejection apparatus including a liquid ejection head.

12. A liquid ejection system comprising:

the tank according to claim 1;

a liquid ejection head; and an exterior portion that houses the tank and the liquid ejection head, wherein the tank has a visual check portion that enables a liquid surface of liquid contained in the liquid containing portion to be visually checked from the outside, and the exterior portion is provided at a position opposing the visual check portion of the tank, and has a window portion that enables the visual check portion to be visually checked from the outside of the exterior portion.

13. The liquid ejection apparatus according to claim 12, wherein the visual check portion includes an upper limit index portion that indicates a guide of an upper limit position of the liquid surface in the liquid containing portion when the tank is in the first orientation, and the first air introduction portion is located above the upper limit index portion in the first orientation.

14. The liquid ejection apparatus according to claim 12, wherein the exterior portion includes, at a position opposing the tank contained in the exterior portion, a lid member that is attached in an openable and closable manner and is provided with the window portion.

* * * * *